US009069304B2

(12) United States Patent
Seshita et al.

(10) Patent No.: US 9,069,304 B2
(45) Date of Patent: Jun. 30, 2015

(54) IMAGE FORMING APPARATUS

(71) Applicants: Takuya Seshita, Kanagawa (JP); Masahiko Satoh, Tokyo (JP); Masaaki Yoshikawa, Tokyo (JP); Hiroshi Yoshinaga, Chiba (JP); Naoki Iwaya, Tokyo (JP); Hiromasa Takagi, Tokyo (JP); Takahiro Imada, Kanagawa (JP); Hajime Gotoh, Kanagawa (JP); Akira Suzuki, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takeshi Uchitani, Kanagawa (JP); Takamasa Hase, Shizuoka (JP); Shuutaroh Yuasa, Kanagawa (JP)

(72) Inventors: Takuya Seshita, Kanagawa (JP); Masahiko Satoh, Tokyo (JP); Masaaki Yoshikawa, Tokyo (JP); Hiroshi Yoshinaga, Chiba (JP); Naoki Iwaya, Tokyo (JP); Hiromasa Takagi, Tokyo (JP); Takahiro Imada, Kanagawa (JP); Hajime Gotoh, Kanagawa (JP); Akira Suzuki, Tokyo (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Takeshi Uchitani, Kanagawa (JP); Takamasa Hase, Shizuoka (JP); Shuutaroh Yuasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/072,027

(22) Filed: Nov. 5, 2013

(65) Prior Publication Data

US 2014/0133879 A1 May 15, 2014

(30) Foreign Application Priority Data

Nov. 13, 2012 (JP) ..... 2012-249077

(51) Int. Cl.
*G03G 15/20* (2006.01)

(52) U.S. Cl.
CPC ..... *G03G 15/205* (2013.01); *G03G 2215/2035* (2013.01)

(58) Field of Classification Search
USPC ..... 399/70
See application file for complete search history.

(56) References Cited

U.S. PATENT DOCUMENTS

| | | | | |
|---|---|---|---|---|
| 2003/0053814 | A1 | 3/2003 | Suzuki et al. | |
| 2006/0127112 | A1 * | 6/2006 | Ono | 399/38 |

(Continued)

FOREIGN PATENT DOCUMENTS

| | | | |
|---|---|---|---|
| JP | 03-145683 | A | 6/1991 |
| JP | 05-070822 | B | 10/1993 |
| JP | 07-199721 | A | 8/1995 |
| JP | 2003-186344 | A | 7/2003 |
| JP | 2003-280486 | A | 10/2003 |

(Continued)

*Primary Examiner* — Clayton E Laballe
*Assistant Examiner* — Jas Sanghera
(74) *Attorney, Agent, or Firm* — Harness, Dickey & Pierce

(57) ABSTRACT

In the present invention, upon return from a standby mode or sleep mode, image data is acquired as warming-up time estimate information for estimating the warming-up time to increase the temperature of a fixing belt to a target fixing temperature and, if the acquired image data is the data on a black-and-white image, control is performed to delay the heating start timing of the fixing belt.

18 Claims, 12 Drawing Sheets

(56) References Cited

U.S. PATENT DOCUMENTS

| | | | | |
|---|---|---|---|---|
| 2006/0269312 | A1* | 11/2006 | Muraishi | 399/88 |
| 2007/0292175 | A1 | 12/2007 | Shinshi | |
| 2009/0067863 | A1* | 3/2009 | Sakata | 399/66 |
| 2009/0169232 | A1 | 7/2009 | Kunii et al. | |
| 2011/0070003 | A1 | 3/2011 | Shinshi | |
| 2013/0188977 | A1 | 7/2013 | Hase et al. | |
| 2013/0195493 | A1 | 8/2013 | Hase et al. | |
| 2013/0202320 | A1 | 8/2013 | Hase et al. | |
| 2013/0209128 | A1 | 8/2013 | Saito et al. | |
| 2013/0251390 | A1 | 9/2013 | Ishii et al. | |

FOREIGN PATENT DOCUMENTS

| | | | |
|---|---|---|---|
| JP | 2003-304355 | A | 10/2003 |
| JP | 2006-163298 | A | 6/2006 |
| JP | 2007-334205 | A | 12/2007 |
| JP | 2008-158482 | A | 7/2008 |
| JP | 2008-216928 | A | 9/2008 |
| JP | 4717292 | B | 4/2011 |
| JP | 2011-221082 | A | 11/2011 |

* cited by examiner

IMAGE FORMING APPARATUS

CROSS-REFERENCE TO RELATED APPLICATIONS

The present application claims priority to and incorporates by reference the entire contents of Japanese Patent Application No. 2012-249077 filed in Japan on Nov. 13, 2012.

BACKGROUND OF THE INVENTION

1. Field of the Invention

The present invention relates to an image forming apparatus that includes a fixing device that fixes a formed image to a recording medium with heat, thereby performing a heat fixing operation.

2. Description of the Related Art

In recent years, there has been an increasing demand of the market to further shorten a first print time of image forming apparatuses, such as copiers, printers, facsimile machines, or multifunction peripherals. The first print time refers to the time that elapses from when a print request (image forming command) is received to when an image forming operation is performed after an operation to prepare for image forming is performed and then the first recording medium on which an image is formed is discharged. In image forming apparatuses that include a fixing device that performs a heat fixing operation to fix the formed image to a recording medium with heat, a warming-up time of the fixing device needs to be shortened in order to reduce the first print time. The warming-up time refers to the time taken to increase the temperature of a heating member to a target temperature (a target fixing temperature), whereby the heat fixing operation can be performed upon return from a fixing not-possible state (upon turn-on of the power source or upon return from a standby state).

Fixing devices that use a contact heating system, such as a heating roller system, film heating system, or electromagnetic induction heating system, are widely used to perform a heat fixing operation. Various conventional fixing devices with various systems have been proposed, where various measures are implemented to shorten the warming-up time. For example, in a fixing device with a film heating system, a thin fixing belt (a fixing film) that has a low heat capacity is heated, and the fixing film is brought into contact with a recording medium so that the image is fixed to the recording medium with heat. Thus, an advantage in shortening the warming-up time is produced (Japanese Patent Application Laid-open No. 2007-334205).

FIG. 12 is a schematic view that illustrates the relevant part of a conventional fixing device that uses a film heating system.

The fixing device includes an endless belt (a fixing belt or fixing film) 901, a metallic heat conductor 902 that has nearly a pipe-like shape and is installed within the endless belt 901, and a heat source 903 that is a heat source installed within the metallic heat conductor 902. The fixing device further includes a pressing roller 904 that is a pressing member that is in contact with the metallic heat conductor 902 via the endless belt 901 so as to form a nip section N. The opposing area of the metallic heat conductor 902 that is opposed to the pressing roller 904 is formed to be thinner than the other areas, and the outer circumference of the opposing area of the metallic heat conductor 902 is formed to have a flat surface. The endless belt 901 is rotated in accordance with the rotation of the pressing roller 904 and, at that time, the metallic heat conductor 902 guides the endless belt 901 to move. Furthermore, the endless belt 901 is heated via the metallic heat conductor 902 by the heat source 903 that is a heat source installed within the metallic heat conductor 902 so that the overall endless belt 901 can be heated. With the provision of the thin fixing belt that has a low heat capacity, the warming-up time can be shortened.

As described above, various measures have been implemented in the conventional fixing devices to shorten the warming-up time and, as a result, the first print time of the image forming apparatuses has been shortened. However, it is found out that, as the warming-up time of the fixing devices has been shortened, the following problem occurs.

The first print time of the image forming apparatus depends on the longest one of the start-up times of the operating units that are associated with an image forming operation. In conventional image forming apparatuses, the start-up time (warming-up time) of the fixing device is usually the longest one of the start-up times of the operating units that are associated with an image forming operation. Therefore, the first print time of the image forming apparatus has been reduced by shortening the start-up time of the fixing device.

However, in some cases, as the warming-up time of the fixing device has been shortened, the warming-up time of the fixing device is shorter than the start-up times of the other operating units, such as a controller (control unit). In such a case, the warming-up time of the fixing device elapses earlier than the start-up times of the other operating units. Therefore, it is necessary to keep the fixing temperature of the fixing device during a time period from when warming-up is completed to when the other operating units are started up so that a fixing operation is actually performed. As the fixing operation is not performed during the above time period, the electric power to keep the fixing temperature during the time period is wasted, which results in the problem of occurrence of wasted power consumption.

Especially, in electrophotographic color image forming apparatuses, for example, it is known that the target fixing temperature can be set to be low during a black-and-white mode in which images are formed by using black toner only compared to a color mode in which images are formed by using toner of multiple colors. This is because the amount of toner that adheres to a recording medium during the black-and-white mode is smaller than that during the color mode and therefore a lower fixing temperature is required to perform a fixing operation where toner is melted and softened. Therefore, during the black-and-white mode for which the target fixing temperature is lower, the warming-up time is shorter compared to the color mode for which the target fixing temperature is higher. Thus, the above-described problem is further noticeable during the black-and-white mode.

In consideration of the above-described problem, there is needed to provide an image forming apparatus that is capable of reducing a waste of power consumption that is required to keep the fixing temperature until the other operating units are started up.

SUMMARY OF THE INVENTION

It is an object of the present invention to at least partially solve the problems in the conventional technology.

According to the present invention, there is provided: an image forming apparatus comprising: an image forming unit configured to form an image on a recording medium in accordance with input image information; a fixing unit configured to apply heat of a heated heating member to the image formed on the recording medium by the image forming unit so as to fix the image to the recording medium, thereby performing a heat fixing operation; an information acquiring unit configured to acquire warming-up time estimate information for estimating a warming-up time to increase a temperature of the heating member to a target fixing temperature; and a heating control unit configured to control a heating start timing of the heating member in accordance with the warming-up time estimate information acquired by the information acquiring unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
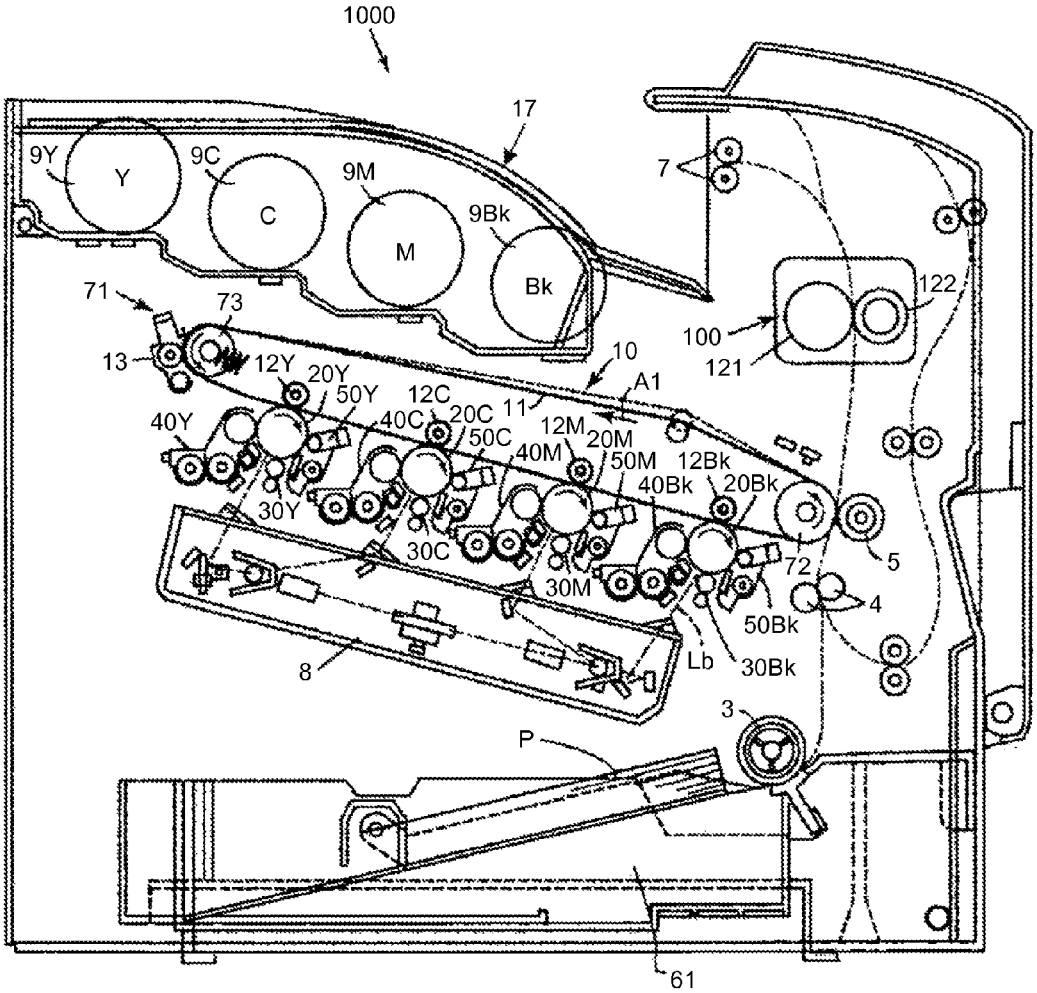
FIG. 1 is a schematic configuration diagram illustrating an example of the configuration of an overall image forming apparatus according to an embodiment.

Exemplary embodiments of an image forming apparatus according to the present invention are explained in detail below with reference to the accompanying drawings.

In the drawings that are used to explain the present embodiment, the same reference numerals and codes are applied to components, i.e., members or constituent parts, that have the same function or configuration as long as they can be distinguished from one another, and after they are explained once, the explanations thereof are omitted.

First, an explanation is given of the overall configuration of the image forming apparatus according to the present embodiment.

FIG. 1 is a schematic configuration diagram illustrating an example of the configuration of the overall image forming apparatus according to the present embodiment.

The image forming apparatus illustrated in FIG. 1 is a tandem color laser printer. An image station is provided at the central part of the apparatus main body, and the image station includes image forming units (the four image forming units in the illustrated example) that form multiple color images. The image forming units are arranged along the extending direction of an intermediate transfer belt (hereafter, referred to as the "transfer belt") 11 that is an endless belt-like intermediate transfer member. The image forming units have the same configuration except that they contain developers of different colors, i.e., yellow (Y), magenta (M), cyan (C), and black (Bk), that correspond to the color separation components of color images.

As illustrated in FIG. 1, an image forming apparatus 1000 has photosensitive drums 20Y, 20C, 20M, and 20Bk arranged therein as multiple image carriers that correspond to the colors, i.e., yellow, cyan, magenta, and black, that are obtained by color separation. A toner image that is a visible image of each color formed on each of the photosensitive drums 20Y, 20C, 20M, and 20Bk is subjected to a primary transfer operation by the transfer belt 11 that is movable in the direction indicated by the arrowed line A1 (hereinafter, referred to as "the direction A1") while it faces each of the photosensitive drums 20Y, 20C, 20M, and 20Bk, whereby the toner image of each color is transferred onto the transfer belt 11 in a superimposed manner. Afterward, the toner image of each color that is transferred onto the transfer belt 11 in a superimposed manner is subjected to a secondary transfer operation by a sheet P that is a recording medium, whereby the toner images are collectively transferred onto the sheet P.

Various devices are installed around each of the photosensitive drums 20Y, 20C, 20M, and 20Bk so as to perform an image forming process in accordance with the rotation of the photosensitive drum. Here, the photosensitive drum 20Bk that forms images of black is used as the subject of explanation. Around the photosensitive drum 20Bk are installed a charge device 30Bk, a developing device 40Bk, a primary transfer roller 12Bk that is a primary transfer unit, and a cleaning device 50Bk, and they perform an image forming process along the direction of the rotation of the photosensitive drum 20Bk. In order to write an electrostatic latent image on the charged photosensitive drum 20Bk, an optical writing device 8 is used as an exposure unit that emits light to the surface of the photosensitive drum 20Bk.

The optical writing device 8 includes a semiconductor laser that is a light source, a coupling lens, an fθ lens, a toroidal lens, a reflection mirror, a rotary polygon mirror (polygon mirror) that is a light deflection unit, or the like. The optical writing device 8 is configured to emit a write light (laser light) Lb to the surface of each of the photosensitive drums 20Y, 20C, 20M, and 20Bk on the basis of image data so as to form electrostatic latent images on the photosensitive drums 20Y, 20C, 20M, and 20Bk.

For superimposition and transfer onto the transfer belt 11, the visible images (toner images) formed on the photosensitive drums 20Y, 20C, 20M, and 20Bk are transferred to the same location of the transfer belt 11 in a superimposed manner while the transfer belt 11 is moved in the direction A1 illustrated in the drawing. More specifically, a primary transfer bias is applied to each of primary transfer rollers 12Y, 12C, 12M, and 12Bk that are arranged such that they face the photosensitive drums 20Y, 20C, 20M, and 20Bk with the transfer belt 11 interposed therebetween. By the primary transfer rollers 12Y, 12C, 12M, and 12Bk to which the primary transfer bias is applied, the visible images (the toner images) formed on the photosensitive drums 20Y, 20C, 20M, and 20Bk are transferred in a superimposed manner on the transfer belt 11 from the upstream side to the downstream side thereof in the direction A1 at different timings.

A primary transfer nip is formed between each of the primary transfer rollers 12Y, 12C, 12M, and 12Bk and a corresponding one of the photosensitive drums 20Y, 20C, 20M, and 20Bk with the transfer belt 11 interposed therebetween. Furthermore, each of the primary transfer rollers 12Y, 12C, 12M, and 12Bk is connected to an undepicted power source so that the primary transfer bias of a predetermined direct-current (DC) voltage and/or alternate-current (AC) voltage is applied to each of the primary transfer rollers 12Y, 12C, 12M, and 12Bk.

The photosensitive drums 20Y, 20C, 20M, and 20Bk are arranged in the order they appear in this sentence from the upstream side along the direction A1 illustrated in FIG. 1. The photosensitive drums 20Y, 20C, 20M, and 20Bk are installed in the image forming units that form images in yellow, cyan, magenta, and black.

Moreover, the image forming apparatus 1000 includes, in addition to the above-described image forming units, a transfer belt unit (transfer device) 10 that is located above the photosensitive drums 20Y, 20C, 20M, and 20Bk, a secondary transfer roller 5 that is a secondary transfer unit, a transfer-belt cleaning device 13, and the optical writing device 8 that is located below the image forming units.

In addition to the above-described transfer belt 11, which is an endless belt, and the primary transfer rollers 12Y, 12C, 12M, and 12Bk, the transfer belt unit 10 includes a plurality of belt supporting members, such as a drive roller 72 and a driven roller 73 between which the transfer belt 11 extends. When the drive roller 72 is driven and rotated, the transfer belt II is moved around (rotated) in the direction A1 in the drawing. The drive roller 72 also serves as a secondary-transfer backup roller that faces the secondary transfer roller 5 with the transfer belt 11 interposed therebetween. The driven roller 73 also serves as a cleaning backup roller that faces the transfer-belt cleaning device 13 with the transfer belt 11 interposed therebetween. Furthermore, the driven roller 73 also serves as a tension applying unit with respect to the transfer belt 11; therefore, the driven roller 73 is provided with a biasing unit that uses a spring, or the like. A transfer device 71 is configured to include the transfer belt unit 10, the primary transfer rollers 12Y, 12C, 12M, and 12Bk, the secondary transfer roller 5, and the transfer-belt cleaning device 13.

The secondary transfer roller 5 is arranged such that it faces the transfer belt 11 and is rotated in accordance with the movement of the transfer belt 11. Furthermore, the transfer belt 11 is sandwiched between the secondary transfer roller 5 and the drive roller 72, which servers as the secondary-transfer backup roller, whereby a secondary transfer nip is formed therebetween. In the same manner as the primary transfer rollers 12Y, 12C, 12M, and 12Bk, the secondary transfer roller 5 is connected to an undepicted power source so that the secondary transfer bias of a predetermined direct-current (DC) voltage and/or alternate-current (AC) voltage is applied to the secondary transfer roller 5.

The transfer-belt cleaning device 13 is arranged such that it faces the driven roller 73 with the transfer belt 11 interposed therebetween. The transfer-belt cleaning device 13 cleans the surface of the transfer belt 11. In the example illustrated in the drawing, the transfer-belt cleaning device 13 includes a cleaning brush and a cleaning blade that are arranged such that they are in contact with the transfer belt 11. Moreover, an undepicted waste-toner conveyance hose extends from the transfer-belt cleaning device 13 and connects to an inlet port of an undepicted waste-toner container.

The image forming apparatus 1000 further includes a sheet feed cassette (sheet feed device) 61 that is a recording-medium containing unit that contains the recording media, i.e., the sheets P; a pair of registration rollers 4 that is a recording-medium feed unit; and an undepicted sheet leading-end sensor that is a recording-medium leading-end detection unit. The sheet feed cassette 61 is located in the lower section of the main body of the image forming apparatus 1000. The sheet feed cassette 61 includes a feed roller 3 that is a recording-medium feed unit that is in contact with the upper surface of the uppermost sheet P. When the feed roller 3 is driven and rotated in a counterclockwise direction, the uppermost sheet P is fed toward the pair of registration rollers 4.

Furthermore, a sheet conveyance path R is provided within the printer main body so as to discharge the sheet P from the apparatus after the sheet P is fed from the sheet feed cassette 61 and passed through the secondary transfer nip. The pair of registration rollers 4 that feeds and conveys the sheet P toward a secondary transfer unit (the secondary transfer nip) is located upstream of the secondary transfer roller 5 in the sheet conveying direction on a sheet conveyance path. The pair of registration rollers 4 feeds the sheet P, which is conveyed from the sheet feed cassette 61, toward the secondary transfer unit (the secondary transfer nip) between the secondary transfer roller 5 and the transfer belt 11 at a predetermined timing that is synchronized with the timing in which a toner image is formed by the image station that includes the image forming units. The sheet leading-end sensor detects that the leading end of the sheet P has reached the pair of registration rollers 4.

Here, in addition to regular sheets, sheets that are recording media include heavy sheets, postcards, envelopes, thin sheets, painting sheets (coated sheets or art sheets), tracing papers, OHP sheets, recording sheets, or the like. In addition to a sheet feed cassette, such as the sheet feed cassette 61, a manual sheet feed mechanism may be provided so that sheets can be manually supplied.

The image forming apparatus 1000 further includes a fixing device 100 as a fixing unit that fixes a toner image to the sheet P to which the toner image has been transferred; discharge rollers 7 as a recording-medium discharge unit; a discharge tray 17 as a recording-medium stack unit; and multiple toner bottles 9Y, 9C, 9M, and 9Bk as toner containers. The discharge rollers 7 discharge the fixed sheet P from the main body of the image forming apparatus 1000. The discharge tray 17 is located in the upper section of the main body of the image forming apparatus 1000 so as to stack the sheet P that is discharged from the main body of the image forming apparatus 1000 by the discharge rollers 7.

Each of the toner bottles 9Y, 9C, 9M, and 9Bk is filled with toner of each color, i.e., yellow, cyan, magenta, or black. Each of the toner bottles 9Y, 9C, 9M, and 9Bk is removably attached to a corresponding one of bottle containers that are located in the upper section of the printer main body and are located below the discharge tray 17. Furthermore, an undepicted supply route is provided between each of the toner bottles 9Y, 9C, 9M, and 9Bk and a corresponding one of developing devices 40Y, 40C, 40M, and 40Bk so that toner is supplied from each of the toner bottles 9Y, 9C, 9M, and 9Bk to a corresponding one of the developing devices 40Y, 40C, 40M, and 40Bk via the supply route.

Although not illustrated in detail, the transfer-belt cleaning device 13 included in the transfer device 71 includes the cleaning brush and the cleaning blade that are arranged such that they are opposed to and are in contact with the transfer belt 11. The cleaning brush and the cleaning blade scrape the transfer belt 11 so as to remove undesired material, such as residual toner, from the transfer belt 11, thereby cleaning the transfer belt 11. The transfer-belt cleaning device 13 includes an undepicted discharge unit to convey and dispose the residual toner that has been removed from the transfer belt 11.

Next, an explanation is given of a basic operation of the image forming apparatus 1000 that is configured as described above.

When the image forming apparatus 1000 starts an image forming operation, the photosensitive drums 20Y, 20C, 20M, and 20Bk in the image forming units are driven and rotated by undepicted drive devices in a clockwise direction as illustrated, and the surface of each of the photosensitive drums 20Y, 20C, 20M, and 20Bk is uniformly charged by a corresponding one of charge devices 30Y, 30C, 30M, and 30Bk so that the surface has a predetermined polarity. The optical writing device 8 emits laser light to the charged surface of each of the photosensitive drums 20Y, 20C, 20M, and 20Bk, whereby an electrostatic latent image is formed on the surface of each of the photosensitive drums 20Y, 20C, 20M, and 20Bk. Here, the image information for exposure of each of the photosensitive drums 20Y, 20C, 20M, and 20Bk is the single-color image information that is obtained by separating a desired full-color image into color information on yellow, magenta, cyan, and black. Toner is supplied by the developing devices 40Y, 40C, 40M, and 40Bk to the electrostatic latent image formed on the photosensitive drums 20Y, 20C, 20M, and 20Bk as described above, whereby the electrostatic latent image is developed as a toner image (obtained as a visible image).

Furthermore, when the image forming operation is started, the drive roller (the secondary-transfer backup roller) 72 is driven and rotated in a counterclockwise direction illustrated in FIG. 1 so that the transfer belt 11 is moved around in the direction A1. A constant voltage that has a polarity opposite to that of the charged toner or a voltage on which constant current control is performed is applied to each of the primary transfer rollers 12Y, 12C, 12M, and 12Bk. Thus, a predetermined transfer electric field is formed at the primary transfer nip between each of the primary transfer rollers 12Y, 12C, 12M, and 12Bk and a corresponding one of the photosensitive drums 20Y, 20C, 20M, and 20Bk.

Afterward, the toner image of each color formed on each of the photosensitive drums 20Y, 20C, 20M, and 20Bk reaches the primary transfer nip in accordance with the rotation of the photosensitive drums 20Y, 20C, 20M, and 20Bk, the toner image formed on each of the photosensitive drums 20Y, 20C, 20M, and 20Bk is sequentially transferred to the transfer belt 11 in a superimposed manner due to the transfer electric field formed at the above-described primary transfer nip. Thus, the full-color toner image is carried by the surface of the transfer belt 11. Furthermore, the toner that has not been transferred to the transfer belt 11 and remains on the photosensitive drums 20Y, 20C, 20M, and 20Bk is removed by cleaning devices 50Y, 50C, 50M, and 50Bk. Then, the surface of each of the photosensitive drums 20Y, 20C, 20M, and 20Bk is neutralized by an undepicted neutralization device so that the surface potential is initialized.

In the lower section of the image forming apparatus, the feed roller 3 starts to rotate so that the sheet P is conveyed from the sheet feed cassette 61 to the conveyance path. The sheet P conveyed to the conveyance path is delivered to the secondary transfer nip between the secondary transfer roller 5 and the drive roller (the secondary-transfer backup roller) 72 at an appropriate timing by the pair of registration rollers 4. At this time, the transfer voltage applied to the secondary transfer roller 5 has a polarity opposite to that of the charged toner of the toner image formed on the transfer belt 11; thus, a predetermined transfer electric field is formed at the secondary transfer nip.

Afterward, when the toner images formed on the transfer belt 11 reach the secondary transfer nip in accordance with the movement of the transfer belt 11, the toner images formed on the transfer belt 11 are collectively transferred onto the sheet P due to the transfer electric field formed at the above-described secondary transfer nip. Furthermore, the toner that has not been transferred to the sheet P and remains on the transfer belt 11 is removed by the transfer-belt cleaning device 13, and the removed toner is conveyed to and collected in an undepicted waste-toner container.

The sheet P is then conveyed to the fixing device 100, and the toner image on the sheet P is fixed to the sheet P by the fixing device 100. The sheet P is then discharged from the apparatus by the discharge roller 7 and is stacked on the discharge tray 17.

An explanation is given above of the image forming operation that is performed to form a full-color image on a sheet; however, it is possible to form a single-color image by using any one of the four image forming units or to form two-color or three-color image by using two or three image forming units.

Next, an explanation is given of an example of a specific configuration of the fixing device 100 that is usable in the image forming apparatus 1000 that is configured as described above.

Figure 2:
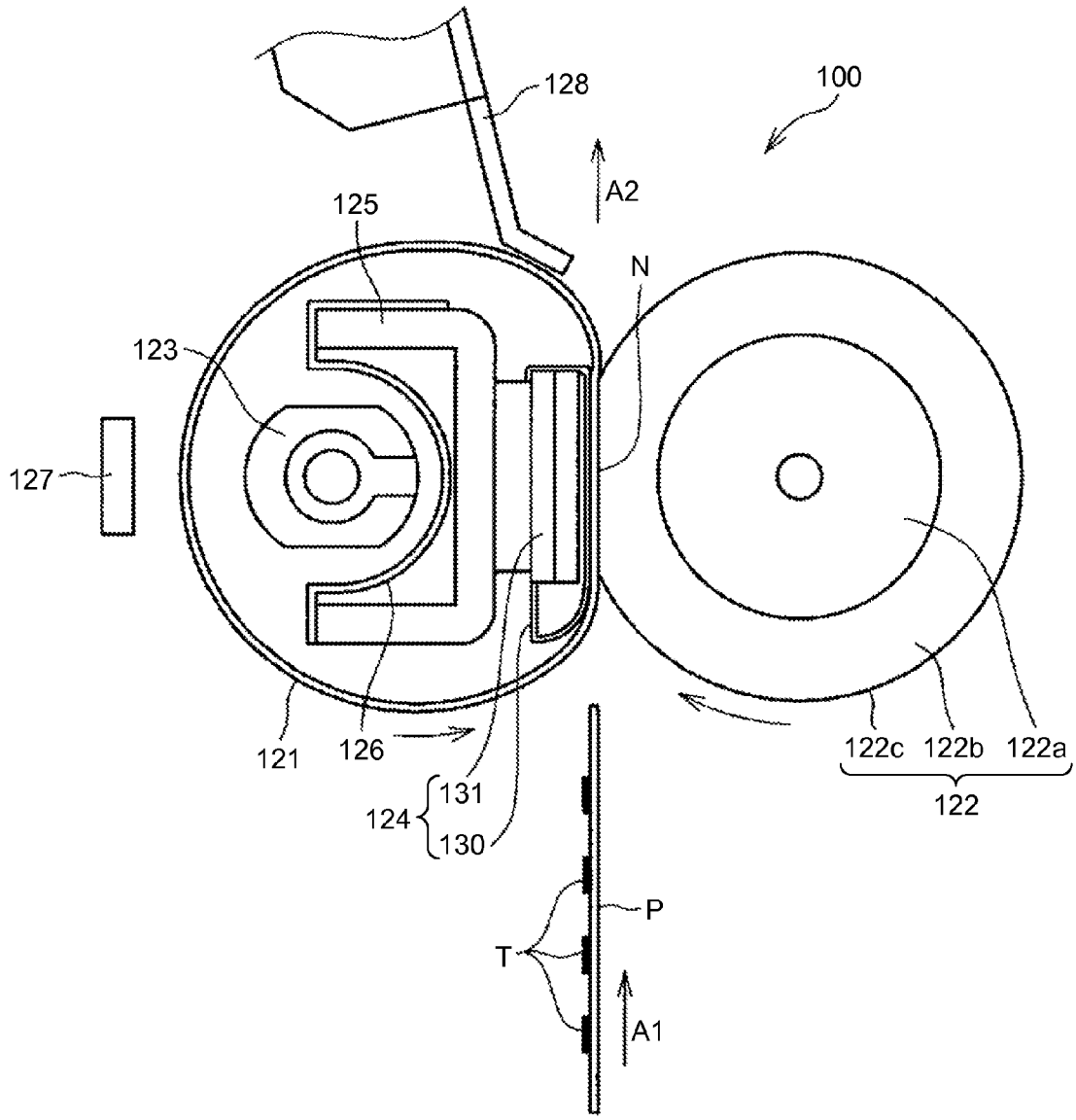
FIG. 2 is a schematic configuration diagram illustrating an example of the configuration of a fixing device of the image forming apparatus.

FIG. 2 is a schematic configuration diagram that illustrates an example of the configuration of the fixing device 100 according to the present embodiment.

As illustrated in FIG. 2, the fixing device 100 includes a fixing belt 121, as an endless movable member, that is a rotatably mounted heating member; a pressing roller 122, as an endless movable member, that is a rotatably mounted pressing member opposed to the fixing belt 121; and a halogen heater 123 as a heat source that heats the fixing belt 121. The fixing device 100 further includes a nip forming unit that includes a nip forming member 124 that is opposed to the pressing roller 122 via the fixing belt 121 and that forms a nip section N with the pressing roller 122 and that includes a stay 125 as a supporting member that supports the nip forming member 124; and a reflection member 126 that reflects the electromagnetic wave or light emitted by the halogen heater 123 to the fixing belt 121. The fixing device 100 further includes a temperature sensor 127 that is a temperature detection unit that is a heat-accumulation state information acquiring unit included in an information acquiring unit that detects the temperature of the fixing belt 121; a separation member 128 as a recording-medium separation unit that separates the sheet from the fixing belt 121; an undepicted biasing unit that biases the pressing roller 122 toward the fixing belt 121; and the like.

The inner surface of the fixing belt 121 is directly heated by the halogen heater 123 due to its radiation heat. Furthermore, the nip forming member 124 is located within the fixing belt 121, i.e., is located in the inside area surrounded by the inner surface of the fixing belt 121, and is arranged such that the nip forming member 124 directly slides on the inner surface of the fixing belt 121 or indirectly slides on the inner surface of the fixing belt 121 with an undepicted slide sheet interposed therebetween.

Although the above-described nip section N has a flat shape in the example illustrated in FIG. 2, it may have a concave shape or any other shapes. If the above-described nip section N has a concave shape, the leading edge of the sheet P is discharged in a direction toward the pressing roller 122; thus, separation performance can be improved and the occurrence of jams can be reduced.

The fixing belt 121 is made up of an endless belt member (including a film) that is thin and flexible. Specifically, the fixing belt 121 includes a base material on its inner circumference that is made of a metallic material, such as nickel or SUS, or a resin material, such as polyimide (PI), and includes a release layer on its outer circumference that is made of tetrafluoroethylene-perfluoroalkyl vinyl ether copolymer (PFA), polytetrafluoroethylene (PTFE), or the like. The release layer prevents toner adhesion; thus, separation performance is provided. Furthermore, an elastic layer may be interposed between the base material and the release layer, and the elastic layer is made of a rubber material, such as silicone rubber, foamable silicone rubber, or fluorine-containing rubber. In a case where an elastic layer, such as a silicone rubber layer, is provided, when an unfixed image is fixed by applying pressure, it is possible to prevent uneven gloss on a solid area of the image that is like an orange peel (orange-peel image) where the small bumps on the surface of the belt are transferred to the image. In order to effectively prevent the occurrence of uneven gloss like an orange peel (orange-peel image), it is preferable that, for example, a silicone rubber layer having equal to or greater than a predetermined thickness (e.g., equal to or greater than 10041 ml) is provided. If the silicone rubber layer is deformed, the small bumps on the surface of the belt are smoothed out, whereby the orange-peel image can be improved.

The pressing roller 122 includes a cored bar 122*a*, an elastic layer 122*b*, and a release layer 122*c*. The elastic layer 122*b* is provided on the outer circumference of the cored bar 122*a* and is made of foamable silicone rubber, silicone rubber, fluorine-containing rubber, or the like. The release layer 122*c* is provided on the surface of the elastic layer 122*b* and is made of PFA, PTFE, or the like. The pressing roller 122 is pressed against the fixing belt 121 by an undepicted pressing member, such as a spring, and is in contact with the nip forming member 124 via the fixing belt 121. The elastic layer 122*b* of the pressing roller 122 is crushed at the point where the pressing roller 122 is in contact with the fixing belt 121, whereby the nip section N having a predetermined width is formed.

Furthermore, the pressing roller 122 is configured to be driven and rotated when the driving force is transmitted thereto via a gear, or the like, from an undepicted drive source, such as a motor, that is mounted in the main body of the image forming apparatus 1000. When the pressing roller 122 is driven and rotated, the driving force is transmitted to the fixing belt 121 via the nip section N so that the fixing belt 121 is accordingly rotated.

The fixing belt 121 is rotated together with the pressing roller 122. In the case of the example of the configuration illustrated in FIG. 2, the pressing roller 122 is rotated by undepicted drive source, such as a motor, and the driving force is transmitted to the fixing belt 121 via the nip section N so that the fixing belt 121 is rotated. The fixing belt 121 is rotated while it is nipped at the nip section N. Both ends of the fixing belt 121, other than the nip section N, are guided by a belt supporting member 140, which will be explained later, so that the fixing belt 121 is moved.

Although the pressing roller 122 is a solid roller in the present embodiment, it may be a hollow roller. In that case, a heat source, such as a halogen heater, may be installed inside the pressing roller 122. If no elastic layer is provided, the heat capacity is decreased and therefore the fixing performance is improved; however, there is a possibility that, when unfixed toner is pressed and fixed, the small bumps on the surface of the belt are transferred onto the image and thus the gloss is uneven on the solid area of the image. In order to prevent this, it is preferable that the elastic layer having a thickness of equal to or greater than 100 [μm] is provided. With the provision of the elastic layer having a thickness of equal to or greater than 100 [μm], it is possible to smooth out the small bumps due to the elastically deformed elastic layer 122*b*; thus, it is possible to prevent the occurrence of uneven gloss.

The elastic layer 122*b* of the pressing roller 122 may be made of a solid rubber; however, if a heat source is not installed inside the pressing roller 122, a highly thermally insulated rubber, such as a sponge rubber, may be used. Using a highly thermally insulated rubber, such as a sponge rubber, is more preferable as it is less likely to take the heat of the fixing belt 121. Furthermore, a belt member, such as the fixing belt 121 that is a rotary heating member as described above, and a pressing member, such as the pressing roller 122 that is an opposing rotary member, may be configured to not only be in contact with and pressed against each other but also be simply in contact with each other without being pressed against each other.

Both ends of the halogen heater 123 are fixed to side plates 142 (see FIG. 3) of the fixing device 100. A configuration is such that output control is performed by a power source unit that is installed in the main body of the image forming apparatus 1000 so that the halogen heater 123 generates heat. The output control on the halogen heater 123 performed by the power source unit is such that, for example, switching on/off of the halogen heater 123 or the amount of electric current applied to the halogen heater 123 is controlled in accordance with the result of detection on the surface temperature of the fixing belt 121 performed by the temperature sensor 127. With such output control on the heater, it is possible to set the temperature (fixing temperature) of the fixing belt 121 to the target fixing temperature. Furthermore, in addition to the halogen heater, an electromagnetic induction heater (IH), resistance heating element, carbon heater, or the like, may be used as the heat source for heating the fixing belt 121.

The nip forming member 124 includes a base pad 131 and a slide sheet (low-friction sheet) 130 that is mounted on the surface of the base pad 131. The base pad 131 is formed continuously and longitudinally along the axial direction of the fixing belt 121 or the axial direction of the pressing roller 122. The base pad 131 receives pressure from the pressing roller 122 so as to define the shape of the nip section N.

The base pad 131 of the nip forming member 124 is fixedly supported by the stay 125. Thus, it is possible to prevent the nip forming member 124 from being bent due to the pressure from the pressing roller 122 and to obtain a uniform width of the nip along the axial direction of the pressing roller 122.

The base pad 131 of the nip forming member 124 is made of a heat resisting material whose upper temperature limit is equal to or greater than 200 degrees C. Thus, within a toner fixing temperature range, the deformation of the nip forming member 124 due to heat is prevented, the stable condition of the nip section N is ensured, and the quality of output is stabilized. A typical heat resistant resin, such as polyethersulfone (PES), polyphenylene sulfide (PPS), liquid crystalline polymer (LCP), polyether nitrile (PEN), polyamide-imide (PAT), or polyether ether ketone (PEEK), can be used for the base pad 131.

The slide sheet 130 may be provided on at least the surface of the base pad 131 that is opposed to the fixing belt 121. Thus, when the fixing belt 121 is rotated, the fixing belt 121 slides on the low-friction sheet so that the drive torque that occurs in the fixing belt 121 is reduced and the load on the fixing belt 121 due to the friction force is decreased. The configuration without the slide sheet is possible.

It is preferable that the stay 125 is made of a metallic material, such as stainless or iron, that has a high mechanical strength so as to satisfy the bending prevention function of the nip forming member 124. Furthermore, it is preferable that the base pad 131 is made of a material that has a certain degree of hardness in order to ensure the strength. A resin, such as a liquid crystalline polymer (LCP), metal, ceramic, or the like, may be used for the material of the base pad 131.

The reflection member 126 is installed between the stay 125 and the halogen heater 123. In the present embodiment, the reflection member 126 is fixed to the stay 125. The material of the reflection member 126 may be aluminum, stainless, or the like. The reflection member 126 is installed as described above so that the light (radiation heat) emitted by the halogen heater 123 toward the stay 125 is reflected to the fixing belt 121. Thus, it is possible to increase the amount of radiation heat emitted to the fixing belt 121 and to effectively heat the fixing belt 121. Instead of providing the reflection member 126, mirror surface treatment may be applied to the surface of the stay 125, or the like, whereby the same effect can be obtained.

Various measures are implemented in the configuration of the fixing device 100 according to the present embodiment in order to improve the energy saving performance, the first print time, and the like.

Specifically, the area of the fixing belt 121 other than the nip section N can be directly heated by the halogen heater 123 (a direct heating method). According to the present embodiment, nothing is interposed between the halogen heater 123 and the area of the fixing belt 121 that is located on the left side of FIG. 2 so that the radiation heat is directly applied from the halogen heater 123 to the area of the fixing belt 121.

In order to achieve the low heat capacity of the fixing belt 121, the fixing belt 121 is thin and has a small diameter. Specifically, the thickness of the base material included in the fixing belt 121 is set in the range of 20 to 50 [μm], the thickness of the elastic layer included in the fixing belt 121 is set in the range of 100 to 300 [μm], and the thickness of the release layer included in the fixing belt 121 is set in the range of 10 to 50 [μm]. The thickness of the overall fixing belt 121 is set to equal to or less than 1 [mm]. The diameter of the fixing belt 121 is set to 20 to 40 [mm]. In order to further achieve the low heat capacity, it is preferable that the thickness of the overall fixing belt 121 is set to equal to or less than 0.2 [mm]. More preferably, it is set to equal to or less than 0.16 [mm]. Moreover, it is preferable that the diameter of the fixing belt 121 is equal to or less than 30 [mm].

In the present embodiment, a configuration is such that the diameter of the pressing roller 122 is set to 20 to 40 [mm] so that the diameter of the fixing belt 121 is equivalent to the diameter of the pressing roller 122. However, this configuration is not a limitation. For example, they may be formed such that the diameter of the fixing belt 121 is smaller than that of the pressing roller 122. In this case, the curvature of the fixing belt 121 at the nip section N is smaller than that of the pressing roller 122, whereby the sheet (recording medium) P discharged through the nip section N is easily released from the fixing belt 121.

As the fixing belt 121 has a small diameter as described above, the space inside the fixing belt 121 is small. However, as the stay 125 is bent at both ends so as to have a U shape and the halogen heater 123 is housed inside the U shaped section, it is possible to install the stay 125 and the halogen heater 123 within the small space.

Figure 3:
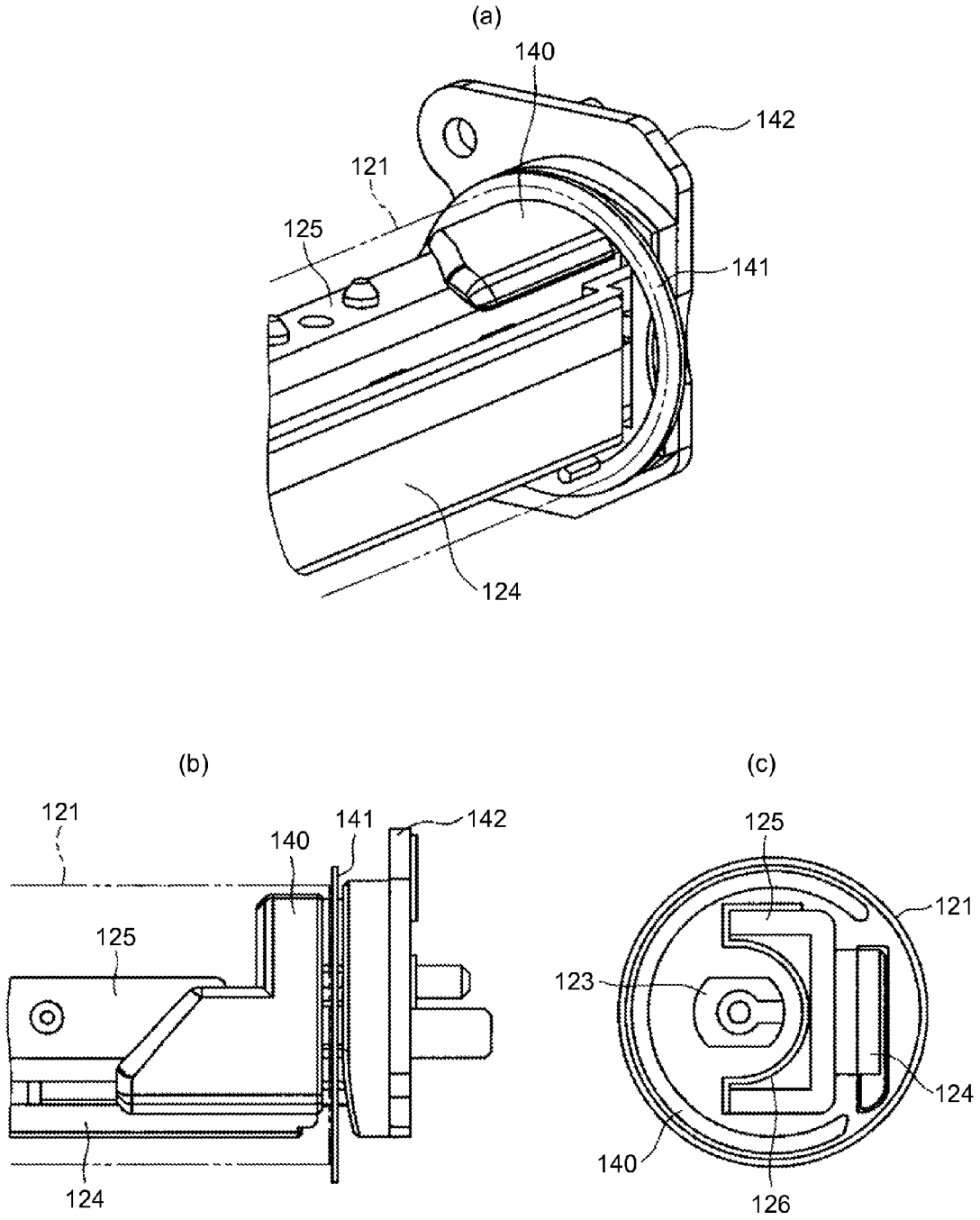
FIG. 3(*a*) is a perspective view illustrating a configuration of an end of a fixing belt of the fixing device, FIG. 3(*b*) is a plan view of the fixing belt, and FIG. 3(*c*) a side view of the fixing belt when viewed in the direction of the rotation axis.

FIG. 3(*a*) is a perspective view that illustrates a configuration of an end of the fixing belt 121, FIG. 3(*b*) is a plan view of the fixing belt 121, and FIG. 3(*c*) is a side view of the fixing belt 121 when viewed in the direction of the rotation axis. Although the configuration of the one end only is illustrated in FIGS. 3(*a*) to 3(*c*), the other end has the same configuration; therefore, an explanation is given below, with reference to FIGS. 3(*a*) to 3(*c*), of the configuration of one end only.

As illustrated in FIGS. 3(*a*) and 3 (*b*), the belt supporting member 140 is installed at the end of the fixing belt 121 with respect to the direction (the axial direction) perpendicular to the moving direction of the surface of the fixing belt 121, and the end of the fixing belt 121 is rotatably supported by the belt supporting member 140. Furthermore, as illustrated in FIG. 3(*c*), the belt supporting member 140 is shaped like, for example, a flange and has a C shape, where an opening is formed at the position of the nip section N (the position where the nip forming member 124 is installed). Furthermore, the belt supporting member 140 is fixed to the side plate 142. Moreover, the end of the stay 125 in the longitudinal direction is also fixed to the side plate 142, whereby the position thereof is determined. In the same manner as the stay 125, the side plate 142 is formed of a metallic material, such as stainless or iron. As the side plate 142 is made of the same material as the stay 125, the assembly accuracy is easily obtained.

Furthermore, as illustrated in FIGS. 3(*a*) and 3(*b*), a slip ring 141 that is a protecting member is provided between the end of the fixing belt 121 and the opposing surface of the belt supporting member 140 that is opposed to the fixing belt 121 so as to protect the end of the fixing belt 121. Thus, it is possible to prevent the end of the fixing belt 121 from being in direct contact with the belt supporting member 140 when the fixing belt 121 deviates in the axial direction; thus, it is possible to prevent the end from being abraded or damaged. The slip ring 141 is fitted into the outer circumference of the belt supporting member 140 with some allowance provided therebetween. Therefore, the slip ring 141 can rotate together with the fixing belt 121 when the end of the fixing belt 121 is brought into contact with the slip ring 141; however, the slip ring 141 may remain still without rotating together. It is preferable that what is called a super engineering plastic that has a superior heat resistance property, e.g., PEEK, PPS, PAI, PTFE, or the like, is used for the material of the slip ring 141.

Although not illustrated, a shielding member is provided at each end of the fixing belt 121 in the axial direction and is located between the fixing belt 121 and the halogen heater 123 so as to shield against the heat from the halogen heater 123. Thus, it is possible to, particularly, prevent an excessive increase in the temperature of a non sheet-feed area of the fixing belt while the sheets are continuously fed, and it is possible to prevent the fixing belt from being degraded or damaged due to the heat.

An explanation is given below, with reference to FIG. 2, of an example of a basic operation of the fixing device 100 according to the present embodiment.

When the main power switch of the main body of the image forming apparatus 1000 is turned on (the main power source is turned on), a warming-up operation is started. Specifically, the electric power is applied to the halogen heater 123, and the pressing roller 122 starts to rotate in the clockwise direction illustrated in FIG. 2. Thus, the fixing belt 121 accordingly rotates in the counterclockwise direction illustrated in FIG. 2 due to the friction force with the pressing roller 122. The temperature of the fixing belt 121 is detected by the temperature sensor 127 and, until the temperature of the fixing belt 121 reaches a predetermined temperature, the warming-up operation is performed. During the warming-up operation performed while the main power source is on, the fixing belt 121 is heated so that the temperature of the fixing belt 121 becomes a predetermined temperature (158 degrees C. to 170 degrees C.) that is higher than the fixing temperature.

When the temperature of the fixing belt 121 reaches a predetermined temperature, the electric current applied to the halogen heater 123 is cut off so that the temperature of the fixing belt 121 is decreased to the target fixing temperature. The sheet P that carries an unfixed toner image T after the above-described image forming process is guided by an undepicted guide plate, is conveyed in the direction A1 illustrated in FIG. 2, and is then delivered into the nip section N between the fixing belt 121 and the pressing roller 122 that are in contact with each other. At this time, the electric power supplied to the halogen heater 123 is controlled in accordance with the detection result of the temperature sensor 127 so that the temperature of the fixing belt 121 is kept at the fixing temperature. A specific example is given here. When the temperature sensor 127 detects that the temperature of the fixing belt 121 is the fixing temperature+α a degrees C, the supply of electric power to the halogen heater 123 is stopped. When the temperature sensor 127 detects that the temperature of the fixing belt 121 is the fixing temperature−α degrees C, the supply of electric power to the halogen heater 123 is turned on. Thus, the toner image T is fixed to the surface of the sheet P due to the heat of the fixing belt 121 that is heated by the halogen heater 123 and the pressure between the fixing belt 121 and the pressing roller 122.

The sheet P to which the toner image T is fixed is conveyed through the nip section N in the direction indicated by the arrowed line A2 illustrated in FIG. 2. At that time, the leading edge of the sheet P is brought into contact with the end of the separation member 128, whereby the sheet P is separated from the fixing belt 121. Afterward, the separated sheet P discharged from the apparatus by the discharge rollers and is stacked on the discharge tray, as described above.

When the image forming operation is finished, a transition is made to a standby state for an image forming operation, and then a change is made to a standby mode in which the temperature of the fixing belt 121 is kept at a predetermined temperature (90 degrees C. in the present embodiment) that is lower than the fixing temperature or to a sleep mode (energy-saving mode) in which the supply of electric power to the halogen heater 123 is stopped or the rotation of the pressing roller 122 is stopped. A setting may be made via an operating unit 151 (see FIG. 7), or the like, as to whether a transition is made to the standby mode or the sleep mode after an image forming operation is finished. If the standby mode is set, the temperature of the fixing belt 121 can be promptly increased to the target fixing temperature for a warming-up operation of the subsequent image forming operation; thus, it is possible to shorten the warming-up time. Meanwhile, during the sleep mode, it is possible to reduce the power consumption during standby and achieve energy saving. In the case of a start-up from the standby mode, a warming-up operation is terminated when the temperature of the fixing belt 121 reaches the target fixing temperature. In the case of a start-up from the sleep mode, a warming-up operation is terminated when the temperature of the fixing belt 121 reaches a predetermined temperature that is higher than the target fixing temperature.

Figure 4:
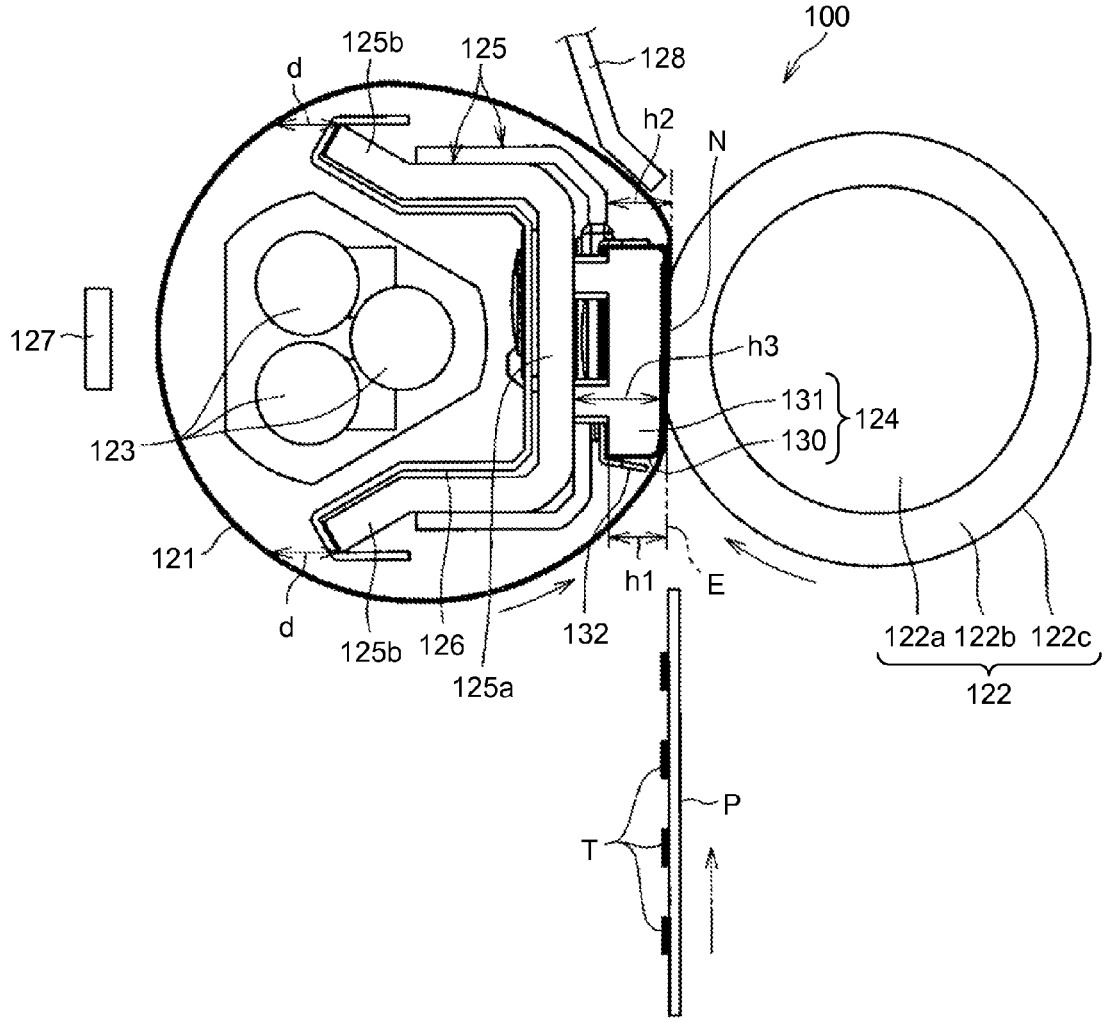
FIG. 4 is a schematic configuration diagram illustrating another example of the configuration of the fixing device.

FIG. 4 is a schematic configuration diagram that illustrates another example of the configuration of the fixing device 100 according to the present embodiment.

In the example of the configuration of the fixing device illustrated in FIG. 4, the components equivalent to those described in FIGS. 2 and 3 are denoted by the same reference numerals, and explanations thereof are omitted.

The fixing device 100 illustrated in FIG. 4 includes the three halogen heaters 123 as heat sources. In this case, each of the halogen heaters 123 generates heat for different areas so that the fixing belt 121 can be heated at an area corresponding to the width of sheets that can have various widths. Furthermore, in this case, a metallic plate 132 is arranged such that it surrounds the nip forming member 124, and the nip forming member 124 is supported by the stay 125 via the metallic plate 132.

Moreover, in the fixing device 100 illustrated in FIG. 4, the nip forming member 124 is formed to have a smaller size so that the stay 125 of as large size as possible can be installed even in a small space. Specifically, the base pad 131 is formed such that the width of the base pad 131 in the sheet conveying direction is smaller than that of the stay 125 in the sheet conveying direction. Furthermore, as illustrated in FIG. 4, if the height of one end of the nip forming member 124 on the upstream side in the sheet conveying direction with respect to the nip section N or an imaginary extended line E is h1, the height of the other end of the nip forming member 124 on the downstream side in the sheet conveying direction with respect to the nip section N or the imaginary extended line E is h2, and the maximum height of a portion of the nip forming member 124 other than the ends thereof on the upstream side and the downstream side with respect to the nip section N or the imaginary extended line E is h3, a configuration is such that $h1 \leq h3$ and $h2 \leq h3$. With this configuration, the ends of the nip forming member 124 on the upstream side and the downstream side are not interposed between the fixing belt 121 and each of the bent portion of the stay 125 on the upstream side and the downstream side in the sheet conveying direction; therefore, the bent portions of the stay 125 can be located close to the inner circumference of the fixing belt 121. Thus, it is possible to install the stay 125 of as large size as possible in the limited space within the fixing belt 121, and it is possible to ensure the strength of the stay 125. As a result, it is possible to prevent the nip forming member 124 from being bent due to the pressing roller 122 and to improve the fixing performance.

In the present embodiment, in order to ensure the strength of the stay 125, the stay 125 is configured to include a base section 125*a* that is in contact with the nip forming member 124 and extends in the sheet conveying direction (the vertical direction in FIG. 4); and rising sections 125*b* that extend, in the contact direction of the pressing roller 122 (to the left side in FIG. 4), from both ends of the base section 125*a* on the upstream side and the downstream side in the sheet conveying direction. That is, as the stay 125 includes the rising sections 125*b*, the stay 125 has a cross-sectional surface that horizontally extends in the pressure direction of the pressing roller 122; therefore, the section modulus is increased, whereby the mechanical strength of the stay 125 can be increased.

Furthermore, if the rising section 125*b* of the stay 125 is formed to be longer in the contact direction of the pressing roller 122, the strength of the stay 125 is increased. Therefore, it is preferable that the end of the rising section 125*b* is placed as close as possible to the inner circumference of the fixing belt 121. However, as various amplitudes of oscillation (disordered behavior) occurs in the fixing belt 121 while it is rotated, there is a possibility that, if the end of the rising section 125*b* is too close to the inner circumference of the fixing belt 121, the fixing belt 121 is brought into contact with the end of the rising section 125*b*. Especially, in the configuration according to the present embodiment where the thin fixing belt 121 is used, if the amplitude of oscillation of the fixing belt 121 is large, the position of the end of the rising section 125*b* needs to be carefully set.

Specifically, in the present embodiment, it is preferable that the distance d between the end of the rising section 125*b* of the stay 125 and the inner circumference of the fixing belt 121 in the contact direction of the pressing roller 122 is set to at least equal to or greater than 2.0 [mm], preferably equal to or greater than 3.0 [mm]. If the fixing belt 121 has a certain thickness and is hardly oscillated, the above-described distance d can be set to 0.02 [mm]. If the reflection member 126 is mounted on the end of the rising section 125*b* as in the present embodiment, it is necessary to set the distance d such that the reflection member 126 is not in contact with the fixing belt 121.

As described above, as the end of the rising section 125*b* of the stay 125 is placed as close as possible to the inner circumference of the fixing belt 121, the rising section 125*b* can be arranged to be longer in the contact direction of the pressing roller 122. Thus, even in the configuration where the small-diameter fixing belt 121 is used, the mechanical strength of the stay 125 can be increased.

Figure 5:
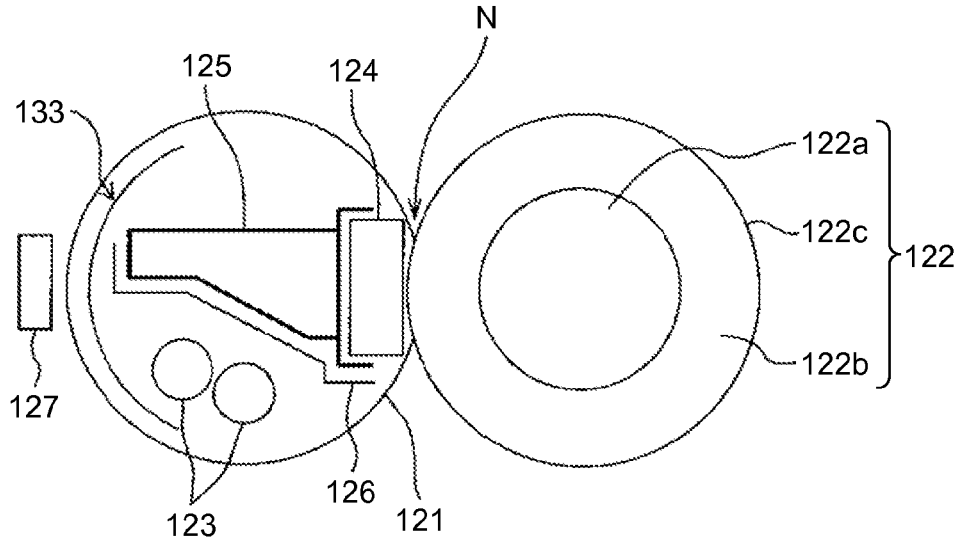
FIG. 5 is a schematic configuration diagram illustrating another example of the configuration of the fixing device.

FIG. 5 is a schematic configuration diagram that illustrates another example of the configuration of the fixing device 100 according to the present embodiment.

In the example of the configuration of the fixing device illustrated in FIG. 5, the components equivalent to those described in FIGS. 2 and 3 are denoted by the same reference numerals, and explanations thereof are omitted.

Figure 6:
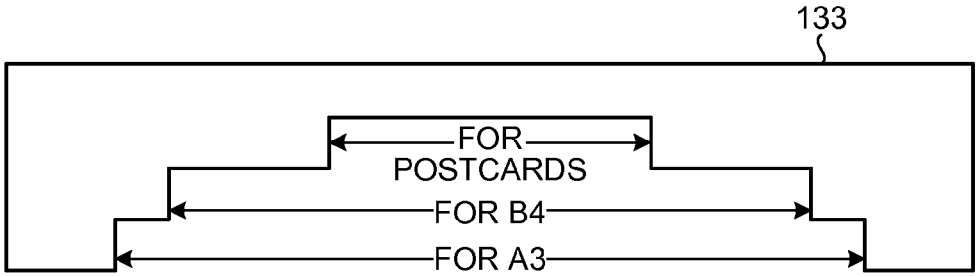
FIG. 6 is a development view of a light shielding member installed in the fixing device according to the configuration example.

The basic configuration of the fixing device 100 illustrated in FIG. 5 is similar to those of the two configuration examples described above, and the primary difference between them is that a light shielding member 133 is provided. As illustrated in FIG. 6, the form of the light shielding member 133 is a stepped form so as to have a different light shielding area corresponding to the sheet width of a sheet that can be delivered. The light shielding member 133 is arranged such that it rotates along the inner circumference of the fixing belt 121 in a non-contact manner. The light shielding member 133 is rotated to the rotation position that corresponds to the width of the delivered sheet P, whereby it is possible to adjust, depending on the width of the delivered sheet P, the amount of electromagnetic wave or light that is emitted by the halogen heater 123 and then reaches the fixing belt 121. For example, even if a heat fixing process is continuously performed on the narrow sheets P, it is possible to prevent an excessive increase in the temperature of the areas of the fixing belt (the areas at both ends of the fixing belt 121) that are not in contact with the sheet P at the nip section N, i.e., that are at the non sheet-delivered area. As a result, it is not necessary to perform control to reduce the productivity, or the like, so as to cancel the area where the temperature is excessively increased. Accordingly, it is possible to reduce the number of halogen heaters 123 from three to two, compared to the configuration example illustrated in FIG. 4.

As described above, in the fixing devices 100 according to the configuration examples illustrated in FIGS. 2 to 6, the nip forming member 124 is capable of guiding the fixing belt 121 that is about to enter the nip section N; therefore, it is possible to control the behavior of the fixing belt 121 before the fixing belt 121 enters the nip section N and to make the fixing belt 121 enter the nip section N in a stable and smooth manner. As the nip forming member 124 guides the fixing belt 121, it is possible to rotate the fixing belt 121 in a stable and smooth manner even in a configuration where any other guide members than the nip forming member 124 are not provided at the area of the fixing belt 121 except for the ends thereof. Thus, it is possible to reduce the load on the fixing belt 121 and prevent the abrasion while it is rotated; thus, damage or breakage of the fixing belt 121 can be prevented, and the reliability of the apparatus is improved. Especially, even in a configuration where the fixing belt 121 is thin in order to achieve the low heat capacity thereof as in the fixing device 100 according to each of the configuration examples described above, it is possible to prevent the fixing belt 121 from being damaged or broken.

Furthermore, in the fixing devices 100 according to the configuration examples illustrated in FIGS. 2 to 6, as the nip forming member 124 is capable of guiding the fixing belt 121, it is possible to achieve simplification and downsizing of the configuration and reduction in cost. Therefore, it is possible to achieve a lower heat capacity of the fixing device 100; thus, a warming-up time can be shortened, the energy saving performance can be improved, and the first print time can be shortened.

As the nip forming member 124 performs a guide function, there is no need to provide additional guides; therefore, a configuration may be such that nothing is interposed between the inner circumference of the fixing belt 121 and the sections of the stay 125 on the upstream and downstream sides in the sheet conveying direction (such that they are directly opposed to each other). Thus, the stay 125 on the upstream and downstream sides in the sheet conveying direction can be located close to the inner circumference of the fixing belt 121, and the stay 125 of as large size as possible can be installed in the limited space within the fixing belt 121. As a result, even in a configuration where the fixing belt 121 has a small diameter in order to have a low heat capacity, as in the fixing device 100 according to each of the above-described configuration examples, it is possible to ensure the strength of the stay 125, to prevent the nip forming member 124 from being bent due to the pressing roller 122, and to improve the fixing performance.

Furthermore, in the fixing device 100 according to the configuration examples illustrated in FIGS. 2 to 6, as the nip forming member 124 is located at a position inwardly away from the fixing belt 121 in a state where the fixing belt 121 is not in contact with the pressing roller 122, it is possible to obtain a state such that the fixing belt 121 is not strongly pressed against the nip forming member 124 on the upstream and downstream sides of the nip section N in the sheet conveying direction. Thus, it is possible to prevent the sliding load or abrasion that is caused due to the contact between the fixing belt 121 and the nip forming member 124. Furthermore, as the contact force of the fixing belt 121 against the nip forming member 124 is low, it is possible to optimize the route through which the fixing belt 121 enters the nip section N.

In the case of the apparatus in which the rotating speed of the pressing roller 122 is high and the number of sheets to be delivered per minute is large, a thermistor (pressure thermistor) may be provided to detect the temperature of the pressing roller 122. In a high-speed apparatus in which the rotating speed of the pressing roller 122 is high, the amount of heat for the fixing belt 121 tends to be insufficient. Therefore, the pressure thermistor detects the surface temperature of the pressing roller 122 during the warming-up operation and, when each of the surface temperature of the pressing roller 122 and the surface temperature of the fixing belt 121 becomes a predetermined temperature, a transition is made to the fixing operation. Thus, the fixing operation can be performed by the pressing roller 122 in which a sufficient amount of heat is stored, and an insufficient amount of heat for the fixing belt 121 can be prevented. Furthermore, a thermistor may be provided to detect the temperature of the pressing roller 122 at the non sheet-delivered area thereof. When small-sized sheets are continuously delivered, there is a possibility that the temperature of the end of the pressing roller 122 or the fixing belt 121 becomes abnormally high and the apparatus fails to operate properly. In order to prevent the occurrence of such a failure, a thermistor is installed at the non sheet-delivered area to detect the temperature and, when it becomes equal to or higher than a predetermined temperature, control is performed to stop the apparatus.

Figure 7:
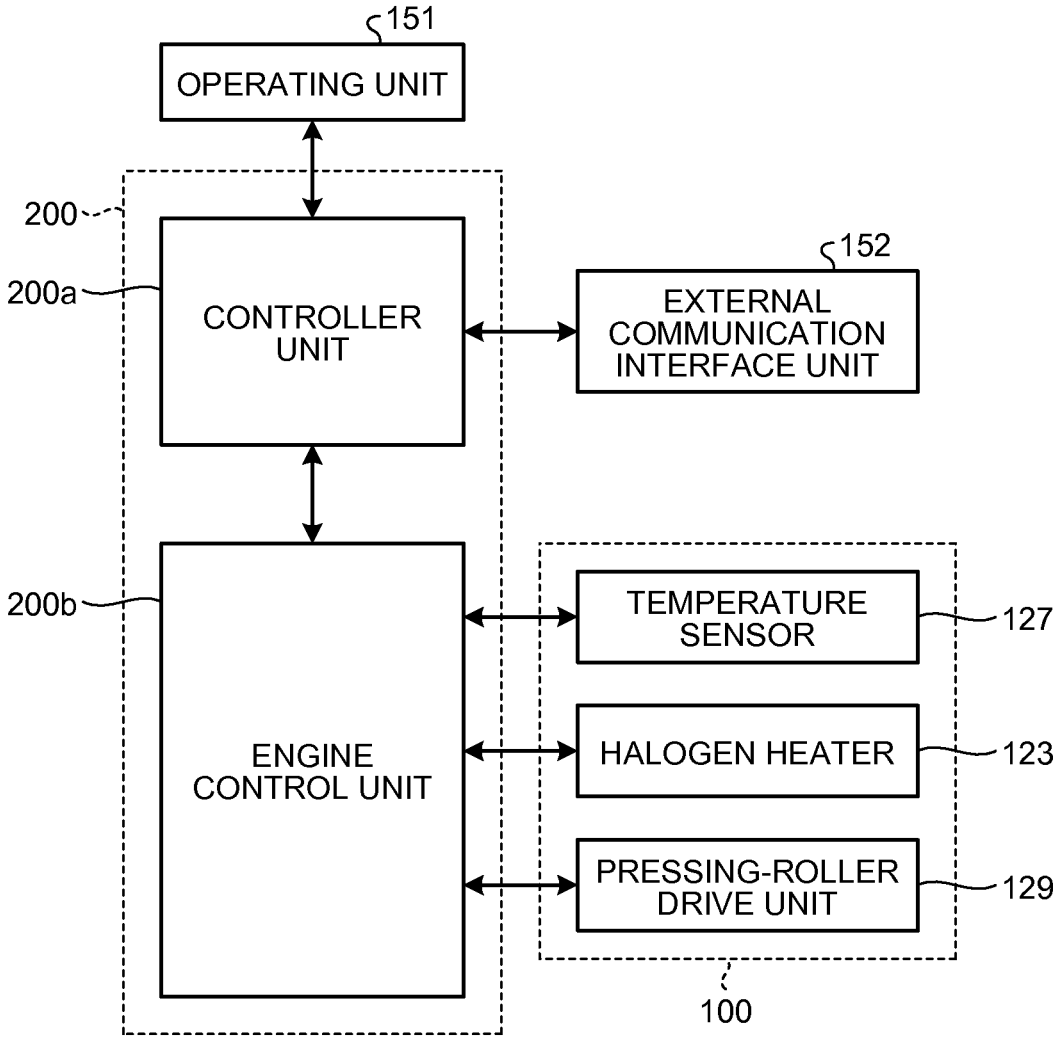
FIG. 7 is a block diagram illustrating an example of the relevant part of a control system that controls the fixing device.

FIG. 7 is a block diagram that illustrates an example of the relevant part of a control system that controls the fixing device 100 according to the present embodiment.

A control unit 200 that is a control unit includes a controller unit 200*a* and an engine control unit 200*b*.

The controller unit 200*a* includes a CPU, a ROM, a RAM, and the like, and is connected to the engine control unit 200*b*, the operating unit 151, an external communication interface unit 152, and the like. The controller unit 200*a* executes a previously installed control program so as to control the overall image forming apparatus 1000, control inputs from the external communication interface unit 152 and the operating unit 151, or the like. For example, the controller unit 200*a* receives an input of the user's instruction that is input via the operating unit 151 and, in accordance with the input instruction, performs various operations. Furthermore, the controller unit 200*a* receives a command for a print job (an image forming job) or image data (image information) from an external host computer, or the like, via the external communication interface unit 152 and controls the engine control unit 200*b* so as to control an image forming operation to form and output a color image or black-and-white image to a sheet.

The engine control unit 200*b* includes a CPU, a ROM, a RAM, and the like, and executes a previously installed control program so as to control a printer engine (the plurality of image forming units, the optical writing device 8, the fixing device 100, and the like) that performs an image forming operation in accordance with a command received from the controller unit 200*a*. For example, during the image forming operation mode, the engine control unit 200*b* controls the electric current applied to the halogen heater 123 so that the temperature of the fixing belt 121, which is detected by the temperature sensor 127, becomes a predetermined target temperature and controls a pressing-roller drive unit 129 that drives and rotates the pressing roller 122.

The image forming apparatus 1000 according to the present embodiment has three modes, i.e., an image forming operation mode, a standby mode, and a sleep mode. Here, the image forming operation mode represents a state where the image forming apparatus 1000 is performing an image forming operation. The standby mode represents a state where the image forming apparatus 1000 waits for an instruction to perform an image forming operation (standby for an image forming operation). The sleep mode represents a low power consumption state where the power consumption is lower than that during the standby mode (standby for an image forming operation). During the image forming operation mode, for example, after a warming-up operation is performed by the fixing device 100 so that the temperature of the fixing belt 121 is increased to a target fixing temperature (e.g., 158 degrees C. to 170 degrees C.), the fixing operation is then performed. During the standby mode, the temperature of the fixing belt 121 in the fixing device 100 is kept at a predetermined temperature (e.g., 90 degrees C.) that is lower than the target fixing temperature during the above-described image forming operation mode. During the sleep mode, a state is obtained such that the electric current applied to the printer engine, such as the fixing device 100 or the engine control unit 200*b*, are cut off so that the supply of electric current to the halogen heater 123 or the driving and rotating of the pressing roller 122 are not performed.

Warming-Up Operation Example 1

Next, an explanation is given of the characterizing portion of the present invention, i.e., an example of a warming-up operation (hereafter, the example is referred to as the "warming-up operation example 1") performed by the fixing device 100 upon return from the standby mode or the sleep mode.

In the following explanation, the warming-up operation performed upon return from the standby mode or the sleep mode is used as an example; however, the same applies to other warming-up operations that are performed when the main power switch of the main body of the image forming apparatus 1000 is turned on, or the like.

Figure 8:
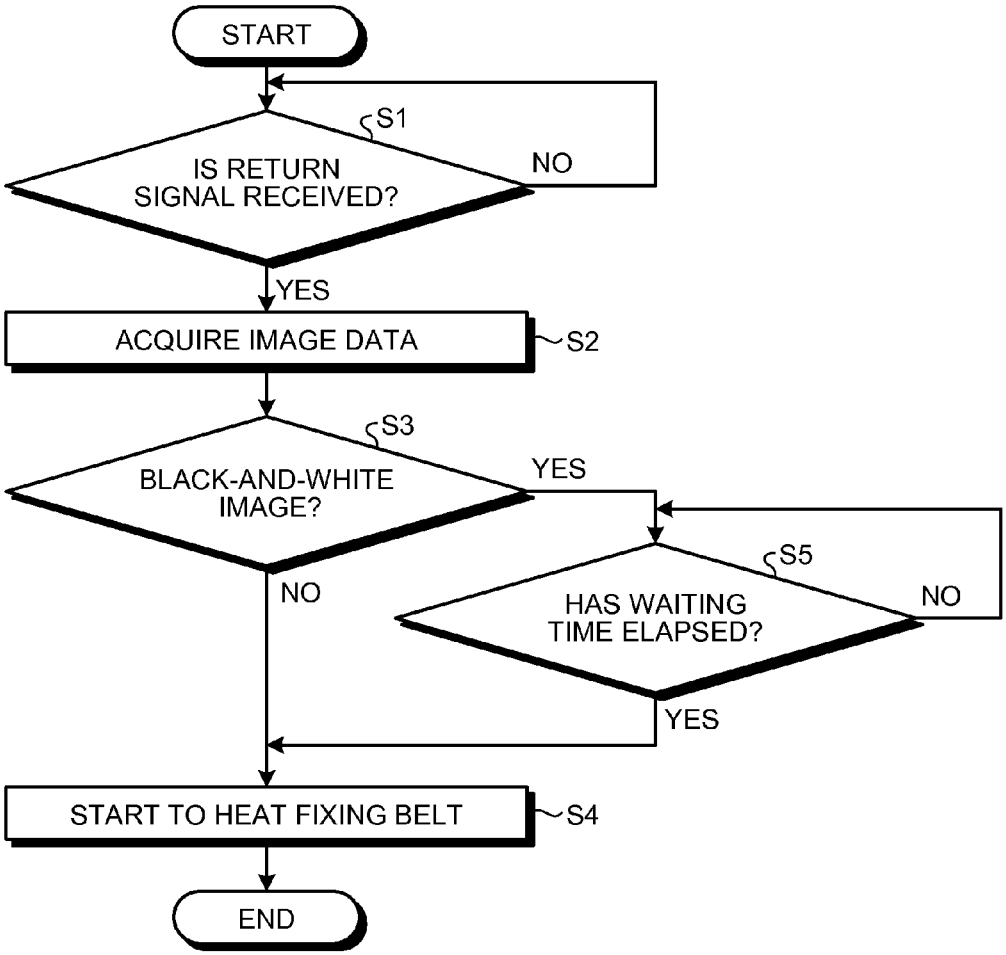
FIG. 8 is a flowchart illustrating the flow of a warming-up operation according to a warming-up operation example 1.

FIG. 8 is a flowchart that illustrates the flow of a warming-up operation according to the warming-up operation example 1.

When the controller unit 200*a* receives a print job during the standby mode or the sleep mode, the controller unit 200*a* outputs a return signal to the engine control unit 200*b*. When receiving the return signal (Yes at Step S1), the engine control unit 200*b* serves as a heating control unit so as to first acquire, from the controller unit 200*a*, image data (image information) as warming-up time estimate information (Step S2). The engine control unit 200*b* then determines whether or not the timing in which the heating of the fixing belt 121 is started needs to be changed.

In the warming-up operation example 1, it is determined whether or not the heating start timing needs to be changed based on the acquired image data, i.e., based on a criterion as to whether the number of colors of toner to be used for the image forming operation performed on the basis of the image data is equal to or fewer than a predetermined number of colors. Here, the predetermined number of colors is one, and a determination is made as to whether the image data is the data on a black-and-white image or the data on a color image (Step S3).

According to the warming-up operation example 1, a predetermined criterion heating start timing is set, and the supply of electric current to the halogen heater 123 is usually started at the criterion heating start timing so that the heating of the fixing belt 121 is started. In the warming-up operation example 1, the criterion heating start timing is set such that, for example, heating is started immediately after a determination is made during the above-described determination operation (Step S3).

If it is determined that the image data is the data on a color image (No at Step S3), it is determined that the timing in which the heating of the fixing belt 121 is started does not need to be changed, and the heating of the fixing belt 121 is started at the criterion heating start timing (S4). Conversely, if the image data is the data on a black-and-white image (Yes at Step S3), it is determined that the timing in which the heating of the fixing belt 121 is started needs to be changed, and the heating of the fixing belt 121 is started at a predetermined special heating start timing that is later than the above-described criterion heating start timing. Specifically, after a determination is made at the above-described determination operation (Step S3) and after a predetermined waiting time elapses (Step S5), the heating of the fixing belt 121 is started (Step S4).

Usually, the amount of toner that adheres to the sheet P that has a toner image formed by using toner of one color only during an image forming operation is smaller than that has a toner image formed by using toner of two or more colors during an image forming operation. As the amount of toner that adheres to the sheet P is smaller, a required fixing temperature can be lower; therefore, in the present embodiment, if the image data is the data on a black-and-white image, the target fixing temperature is set to be lower than that in a case where the image data is the data on a color image. Thus, if it is the data on a black-and-white image, the temperature of the fixing belt 121 reaches the target fixing temperature more quickly compared to a case where it is the data on a color image. Thus, the warming-up time is shorter.

In the image forming apparatus according to the present embodiment, the fixing device 100 is configured such that the warming-up time for color images nearly equals the start-up time of the controller unit 200*a* or the engine control unit 200*b*. Therefore, the warming-up time for black-and-white images is shorter than the start-up time of the controller unit 200*a* or the engine control unit 200*b*. In a case where the heating start timing during the warming-up operation for a black-and-white image is set to be the same as that for a color image, after the temperature of the fixing belt 121 is increased to the target fixing temperature and thus the warming-up operation is completed, there is a need to wait for the completion of start-up of the controller unit 200*a*, and the like, and to keep the fixing temperature. The power consumed to keep the fixing temperature during the time period from when the warming-up operation is completed to when the start-up of the controller unit 200*a*, and the like, is completed is a waste of power.

According to the warming-up operation example 1, if the acquired image data is the data on a black-and-white image, the heating start timing is later than that in a case where the image data is the data on a color image; therefore, the time period from when the warming-up operation is completed to when the start-up of the controller unit 200*a*, and the like, is completed becomes shorter, and thus the wasted power consumption during that time period can be reduced. Especially, according to the warming-up operation example 1, the heating start timing is delayed so that the timing in which the warming-up operation for a black-and-white image is completed nearly equals the timing in which the start-up of the controller unit 200*a* or the engine control unit 200*b* is completed. Thus, the wasted power consumption during the above-described time period can be actually prevented.

In the warming-up operation example 1, an explanation is given of a case where the heating start timing is delayed for a black-and-white image, i.e., an image that is formed by using toner of black (Bk) only; however, this is not a limitation. For example, the heating start timing may be delayed for a case where an image is formed by using toner of another color, such as yellow, cyan, or magenta, only. Furthermore, the heating start timing for a case where an image is formed by using toner of any two or three colors may be delayed compared to the heating start timing for a case where a full-color image is formed by using toner of four colors.

Furthermore, in the warming-up operation example 1, the criterion heating start timing is set to be earlier and, if it is determined that the heating start timing needs to be changed on the basis of the acquired image data, the heating of the fixing belt 121 is started at a predetermined special heating start timing that is later than the criterion heating start timing; however, this is not a limitation. For example, the criterion heating start timing may be set to be later and, if it is determined that the heating start timing needs to be changed on the basis of the acquired image data, the heating of the fixing belt 121 may be started at a predetermined special heating start timing that is earlier than the criterion heating start timing.

A method of determining a heating start timing is not limited to the above-described method of selecting a heating start timing from multiple predetermined heating start timings on the basis of the image data. For example, a heating start timing may be calculated based on acquired image data in accordance with a predetermined algorithm.

Warming-Up Operation Example 2

Next, an explanation is given of another example of the warming-up operation (hereafter, this example is referred to as the "warming-up operation example 2") performed by the fixing device 100 upon return from the standby mode or the sleep mode.

The warming-up operation example 2 is similar to the above-described warming-up operation example 1 except that, in the warming-up operation example 2, it is determined whether or not the heating start timing needs to be changed by using a criterion as to whether the acquired image data is the data on a text image only. In the following, the difference between the warming-up operation example 1 and the warming-up operation example 2 is mainly explained.

Figure 9:
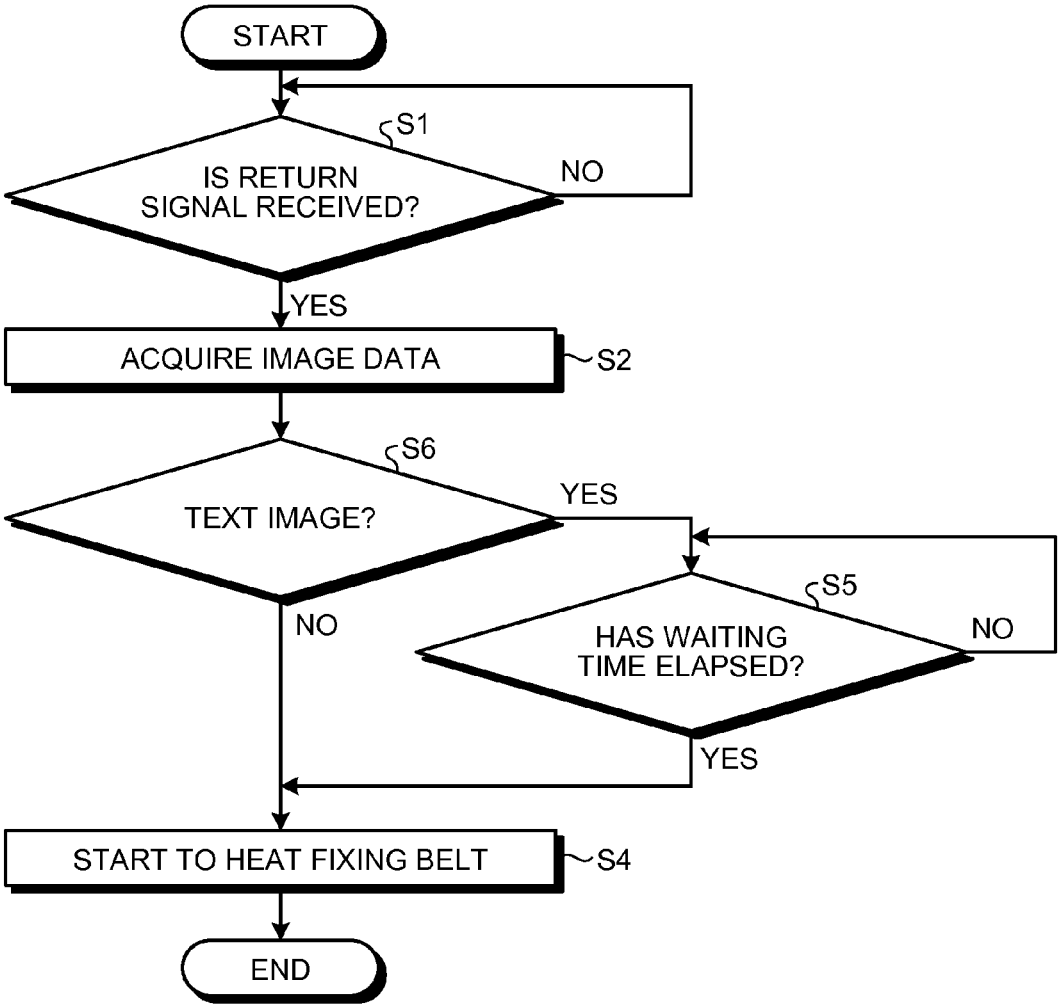
FIG. 9 is a flowchart illustrating the flow of a warming-up operation according to a warming-up operation example 2.

FIG. 9 is a flowchart that illustrates the flow of the warming-up operation according to the warming-up operation example 2.

When the controller unit 200*a* receives a print job during the standby mode or the sleep mode, the controller unit 200*a* outputs a return signal to the engine control unit 200*b*. When receiving the return signal (Yes at Step S1), the engine control unit 200*b* serves as a heating control unit so as to first acquire, from the controller unit 200*a*, the image data (image information) as warming-up time estimate information (Step S2).

If it is determined that the acquired image data is not a text image only (No at Step S6), it is determined that the heating start timing of the fixing belt 121 does not need to be changed; therefore, the heating of the fixing belt 121 is started at the criterion heating start timing (Step S4). Conversely, if it is determined that the image data is a text image only (Yes at Step S6), it is determined that the heating start timing of the fixing belt 121 needs to be changed; therefore, the heating of the fixing belt 121 is started at a predetermined special heating start timing that is later than the above-described criterion heating start timing. Specifically, after a determination is made during the above-described determination operation (Step S6) and after a predetermined waiting time elapses (Step S5), the heating of the fixing belt 121 is started (Step S4).

Due to the edge effect upon toner adherence during a developing process, or the like, the amount of adhering toner per unit area is large and the pile height is high with respect to text images compared to solid images, such as photo images. Furthermore, although a large number of isolated microscopic dots exist in a halftone image, such isolated dots do not exist in a text image. For the above reasons, in the case of a text image, a certain amount of toner mass exists during a fixing process; therefore, it is easy to ensure the fixedness between the sheet P and the toner. Thus, according to the present embodiment, if the image data is a text image only, the target fixing temperature is set to be lower than that in a case where the image data is not a text image only (in a case where the image data includes a halftone image or solid image). Thus, if the data is a text image only, the temperature of the fixing belt 121 reaches the target fixing temperature more quickly compared to a case where the data is not a text image only; thus, the warming-up time becomes shorter.

In the warming-up operation example 2, if the acquired image data is a text image only, the heating start timing is later than that in a case where the image data is not a text image only. Therefore, the time period from when the warming-up operation is completed to when the start-up of the controller unit 200*a*, and the like, is completed becomes shorter, and the wasted power consumption during that time period can be reduced.

Furthermore, it is preferable that, in a low-temperature environment, control is not performed to delay the heating start timing on the basis of acquired image data, as performed in the above-described warming-up operation example 1 and the warming-up operation example 2. Because the temperature of the sheet P is low in a low-temperature environment, a large amount of heat is transferred from the fixing belt 121 to the sheet P during a fixing process; therefore, a drop in the temperature of the fixing belt 121 easily occurs, and there is a possibility of the occurrence of offset. For example, a temperature sensor is provided in the image forming apparatus to detect the ambient temperature and, in accordance with the detection result of the temperature sensor, a determination is made as to whether a control is to be performed to delay the heating start timing. Instead of the temperature sensor that detects the ambient temperature, the temperature sensor 127 included in the fixing device 100 may be used.

Furthermore, it is preferable that, if the input voltage of the outlet is low from which the image forming apparatus receives electric power, a control is not performed to delay the heating start timing on the basis of acquired image data, as performed in the above-described warming-up operation example 1 and the warming-up operation example 2. If the input voltage is extremely low, a drop in the fixing temperature occurs due to an insufficient amount of electric power after the fixing process is started and there is a possibility of occurrence of offset.

Warming-Up Operation Example 3

Next, an explanation is given of another example of the warming-up operation (hereafter, this example is referred to as the "warming-up operation example 3") performed by the fixing device 100 upon return from the standby mode or the sleep mode.

The warming-up operation example 3 is similar to the above-described warming-up operation example 1 except that, in the warming-up operation example 3, the heating start timing is changed in accordance with the heat-accumulation state of the fixing device 100. In the following, the difference between the warming-up operation example 1 and the warming-up operation example 3 is mainly explained.

Figure 10:
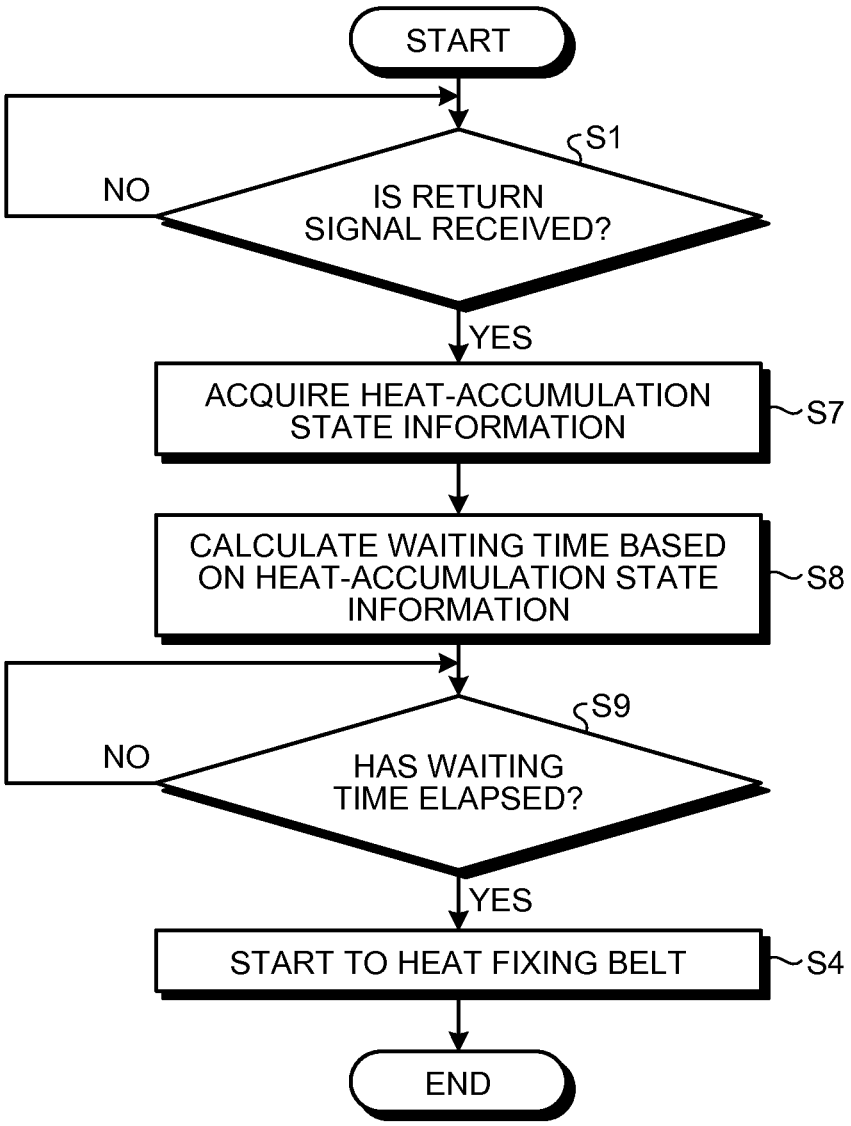
FIG. 10 is a flowchart illustrating the flow of a warming-up operation according to a warming-up operation example 3.

FIG. 10 is a flowchart that illustrates the flow of the warming-up operation according to the warming-up operation example 3.

When the controller unit 200*a* receives a print job during the standby mode or the sleep mode, the controller unit 200*a* outputs a return signal to the engine control unit 200*b*. When receiving the return signal (Yes at Step S1), the engine control unit 200*b* serves as a heating control unit so as to first acquire, from the temperature sensor 127 of the fixing device 100, the temperature information on the fixing belt 121 as heat-accumulation state information (the warming-up time estimate information) (Step S7).

Based on the acquired temperature information, awaiting time is calculated which indicates how long the heating start timing is to be delayed with respect to the criterion heating start timing (Step S8). For example, if the waiting time of 4 seconds is calculated during the calculation operation (Step S8), the heating of the fixing belt 121 is started (Step S4) after a 4 seconds delay (Step S9) from the criterion heating start timing. The criterion heating start timing varies depending on the configuration of the image forming apparatus, and it is specified as appropriate.

If a return is made from the standby mode or the sleep mode immediately after a transition has been made to the standby mode or the sleep mode, most of the heat stored in each unit of the fixing device 100 during the previous image forming operation remains without being released, as a period of time during the standby mode or the sleep mode is short. In this case, the temperature of the fixing belt 121 is kept high at the start time of heating, and the heat for heating the fixing belt 121 is not easily released to other units of the fixing device 100; therefore, the temperature of the fixing belt 121 is increased to the target fixing temperature at a shorter time (warming-up time). In this case, after the temperature of the fixing belt 121 is increased to the target fixing temperature and thus the warming-up operation is completed, there is a need to wait for the completion of start-up of the controller unit 200*a*, and the like, and to keep the fixing temperature; thus, a waste of power consumption occurs.

In the warming-up operation example 3, the heat-accumulation state of the fixing device 100 is determined based on the temperature information on the fixing belt 121 that is acquired from the temperature sensor 127 of the fixing device 100 and, in accordance with the heat-accumulation state, an appropriate waiting time is calculated. Thus, the heating of the fixing belt 121 can be started at an appropriate heating start timing that depends on the heat-accumulation state of the fixing device 100, preferably at a heating start timing such that the timing in which the warming-up operation is completed nearly equals the timing in which the start-up of the controller unit 200*a*, and the like, is completed.

When a return is made from the sleep mode, it is more effective to perform control for changing the heating start timing in accordance with the heat-accumulation state of the fixing device 100, as in the warming-up operation example 3. This is because, as the power source is usually turned on in a state where the temperature of the fixing device 100 has dropped to the ambient temperature, there is no significant change in the heat-accumulation state of the fixing device 100. Furthermore, as the fixing temperature is kept at a predetermined temperature (90 degrees C. in the present embodiment) during the standby mode, there is no significant change in the heat-accumulation state of the fixing device 100 when a return is made from the standby mode.

Although the heat-accumulation state of the fixing device 100 is determined based on the temperature information on the fixing belt 121 according to the warming-up operation example 3, it may be determined based on other information. Especially, if a determination is made based on the temperature information on the pressing roller 122, the heat-accumulation state of the fixing device 100 can be properly determined compared to a case where the temperature information on the fixing belt 121 is used. This is because, as the pressing roller 122 has a larger heat capacity compared to the fixing belt 121, the pressing roller 122 is not likely to be heated or cooled; thus, it is possible to properly determine the heat-accumulation state of the fixing device 100 after a certain time has elapsed.

If the heat-accumulation state of the fixing device 100 is determined based on the temperature information on the fixing belt 121 as in the warming-up operation example 3, it is preferable that the detection sensitivity of the temperature sensor 127 is set to be high. Furthermore, a pattern of changes in the temperature of the fixing belt 121 is previously collected from experiments, or the like, and the temperature change pattern is compared with the detection result to determine the heat-accumulation state of the fixing device 100, whereby a determination can be made in a more accurate manner.

Although determination accuracy is reduced, a detection result of other temperature sensors that are installed within the image forming apparatus, for example, may be used in the method for determining the heat-accumulation state of the fixing device 100. A temperature sensor for determining the installation environment or temperature sensors installed in other units of the image forming apparatus (e.g., temperature sensors, or the like, installed in the optical writing device 8, the developing devices 40Y, 40C, 40M, and 40Bk, the photosensitive drums 20Y, 20C, 20M, and 20Bk, the transfer belt unit 10, the sheet feed cassette 61, a read device, and the like) are often installed in the image forming apparatus. The heat-accumulation state of the fixing device 100 may be indirectly determined by using these temperature sensors as an alternative. In this case, for example, some patterns of connection between the detection result of the temperature and the heat-accumulation state of the fixing device 100 are previously registered, and the pattern is compared with the detection result of the temperature to determine the heat-accumulation state of the fixing device 100, whereby a determination can be made in a more accurate manner.

Furthermore, as a method for determining the heat-accumulation state of the fixing device 100, there is a method in which the time interval after the previous operation is measured and the heat-accumulation state of the fixing device 100 is determined on the basis of the measurement result. In this case, it is preferable that calculation is performed based on the time interval after the previous operation and the details of the operation, as what has been performed during the previous operation has some effects. Furthermore, there is a method in which, for example, the status of use (the number of output sheets, the thickness of a sheet, a color mode, or the like) is recorded after the power source is turned on and the current heat-accumulation state of the fixing device 100 is estimated based on the record. Moreover, there is a method in which, for example, the current heat-accumulation state of the fixing device 100 is estimated based on the status of use (the number of output sheets, the thickness of a sheet, or a color mode) during a certain period of time immediately before a return signal is received.

Furthermore, if the temperature sensor that detects the temperature of the fixing belt 121 or the pressing roller 122 is a non-contact temperature sensor, a different temperature sensor is sometimes installed to detect the ambient temperature where the non-contact temperature sensor is installed or detect the temperature of the non-contact temperature sensor itself. In this case, the difference between the temperature detection result of the different temperature sensor and the temperature detection result of the non-contact temperature sensor is obtained so that the detected temperature of the fixing belt 121 or the pressing roller 122 can be more proper. In this case, the heat-accumulation state of the fixing device 100 may be determined based on the detection result of the above-described different temperature sensor. The temperature sensor may be, for example, PT9S-D312-R1 that is manufactured by Shibaura Electronics Co., Ltd., NC-F10 that is manufactured by SEMITEC Corporation, or the like. Any other sensors may be used.

Warming-Up Operation Example 4

Next, an explanation is given of another example of the warming-up operation (hereafter, this example is referred to as the "warming-up operation example 4") performed by the fixing device 100 upon return from the standby mode or the sleep mode.

The above-described warming-up operation examples 1 to 3 may be combined to one another. The warming-up operation example 4 is an example where the above-described warming-up operation example 1 is combined with the warming-up operation example 3.

Figure 11:
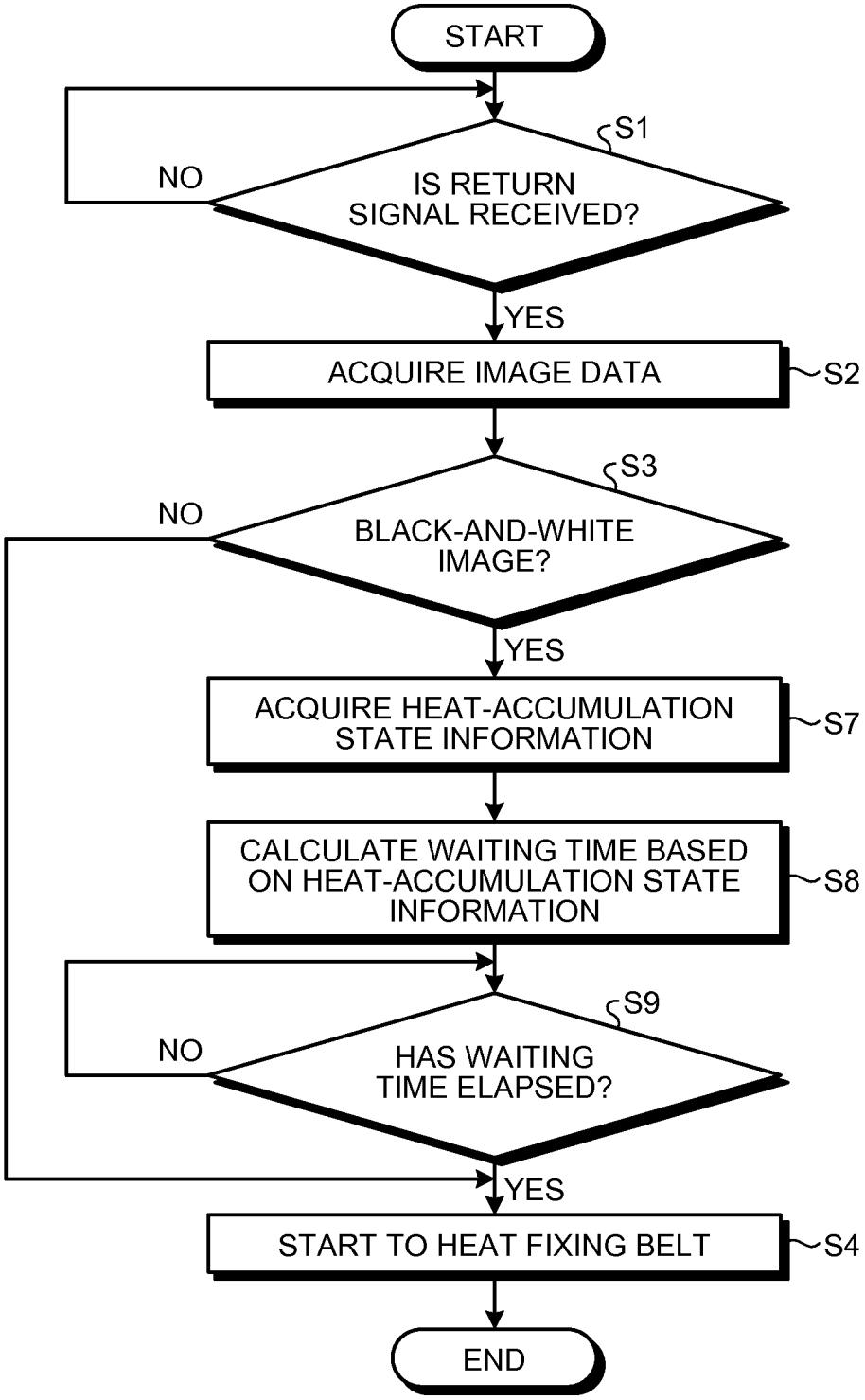
FIG. 11 is a flowchart illustrating the flow of a warming-up operation according to a warming-up operation example 4.
Figure 12:
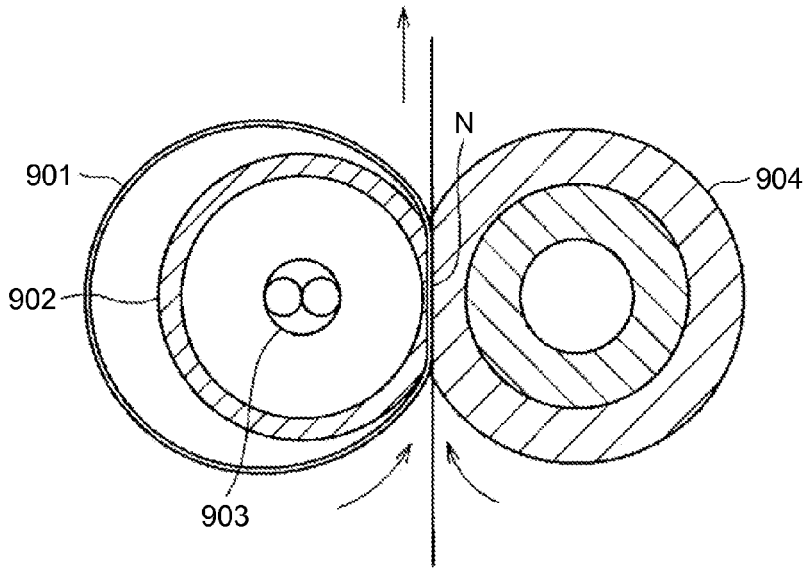
FIG. 12 is a schematic configuration diagram illustrating a fixing device according to a conventional example.

FIG. 11 is a flowchart that illustrates the flow of the warming-up operation according to the warming-up operation example 4.

When the controller unit 200*a* receives a print job during the standby mode or the sleep mode, the controller unit 200*a* outputs a return signal to the engine control unit 200*b*. When receiving the return signal (Yes at Step S1), the engine control unit 200*b* serves as a heating control unit so as to first acquire, from the controller unit 200*a*, the image data (image information) as warming-up time estimate information (Step S2). It is then determined whether the image data is the data on a black-and-white image or the data on a color image (Step S3).

If it is determined that the image data is the data on a color image (No at Step S3), it is determined that the heating start timing of the fixing belt 121 does not need to be changed, and the heating of the fixing belt 121 is started at the criterion heating start timing (Step S4).

Conversely, if it is determined that the image data is the data on a black-and-white image (Yes at Step S3), the temperature information on the fixing belt 121 is then acquired from the temperature sensor 127 of the fixing device as the heat-accumulation state information (the warming-up time estimate information) (Step S7). Awaiting time that indicates how long the heating start timing is to be delayed with respect to the criterion heating start timing is calculated based on the acquired temperature information (Step S8). After the calculated waiting time has elapsed (Step S9), the heating of the fixing belt 121 is started (Step S4).

In the warming-up operation example 4, control may be performed during the operation to calculate the waiting time (Step S8) such that a data table is prepared which defines the correspondence relationship between the heat-accumulation state information and the waiting time and the data table is referred to by using the acquired heat-accumulation state information so that the waiting time is determined. Furthermore, control may be performed such that the acquired heat-accumulation state information is input to a predetermined calculating formula so that the waiting time is calculated.

Not only the warming-up operation example 4 but also any various combination of the above-described warming-up operation examples 1 to 3 may be used. For example, instead of the determination operation (Step S3) in the warming-up operation example 4, the above-described determination operation in the warming-up operation example 2, i.e., the operation to determine whether or not the image data is a text image only, may be performed. For example, if the image data is a black-and-white image and also a text image, or if the image data is a black-and-white image or text image, the heating start timing may be delayed.

In the present embodiment, as a method of controlling the heating start timing, it is preferable to use a method of performing on/off control of a switch unit that is installed between the halogen heater 123 and a power source unit that applies electric current to the halogen heater 123. A specific example will be explained below.

Specific Example 1

Figure 13:
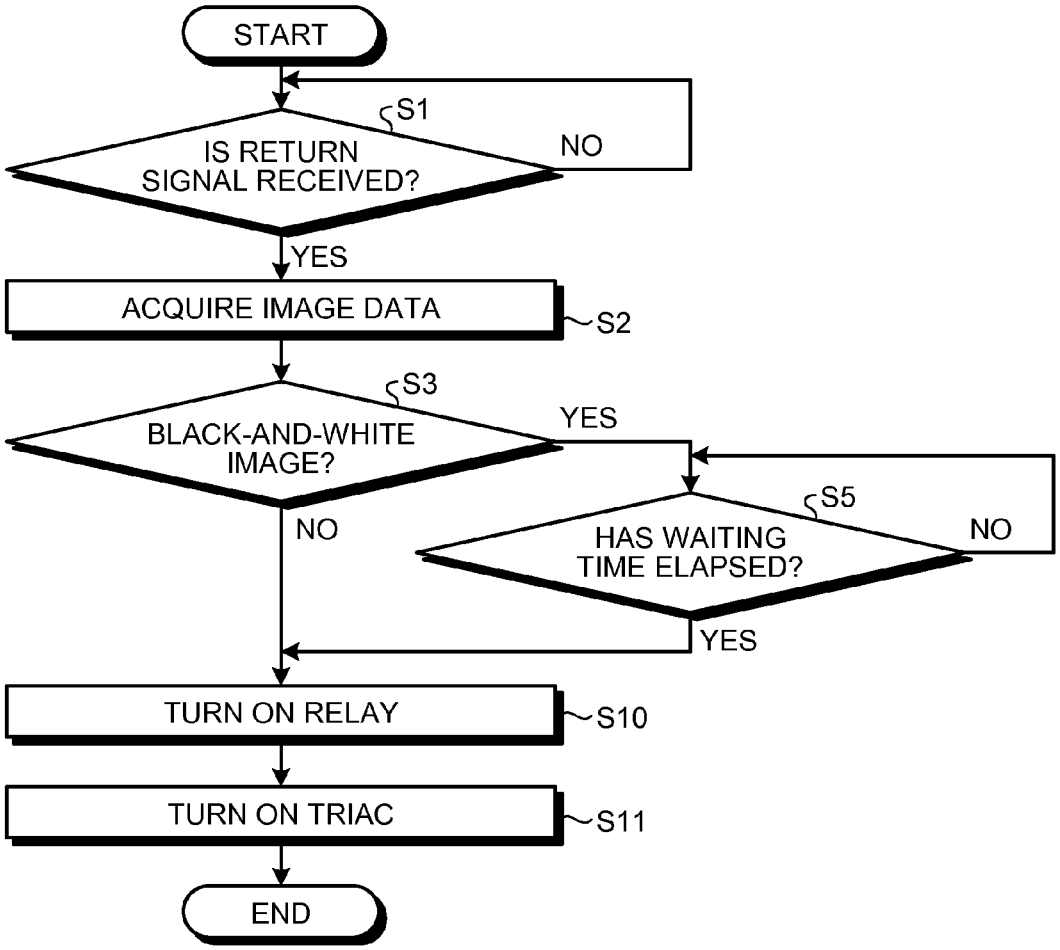
FIG. 13 is a flowchart illustrating a specific example to perform on/off control of a heater in the fixing device according to an embodiment.

FIG. 13 is a flowchart that illustrates a specific example (hereafter, this example is referred to as the "specific example 1") to perform on/off control of a switch unit that is provided between the halogen heater 123 and the power source unit.

According to the present embodiment, a relay (an electric relay) and a TRIAC (bidirectional thyristor) are installed on the power supply route. In the specific example 1, the relay is used as a switch unit to perform on/off control. An explanation is given by using, for example, the above-described warming-up operation example 1. When a return signal is received (Yes at Step S1) and the image data is acquired (Step S2), it is determined whether the image data is the data on a black-and-white image or the data on a color image (Step S3). If it is determined that the image data is the data on a color image (No at Step S3), the relay is first turned on (Step S10) and then the TRIAC is turned on (Step S11). Thus, electric current is applied to the halogen heater 123 so that the heating of the fixing belt 121 is started. Conversely, if it is determined that the image data is the data on a black-and-white image (Yes at Step S3), the relay is turned on (Step S10) after a predetermined waiting time has elapsed (Step S5), and then the TRIAC is turned on (Step S11) so that the heating of the fixing belt 121 is started.

Specific Example 2

Figure 14:
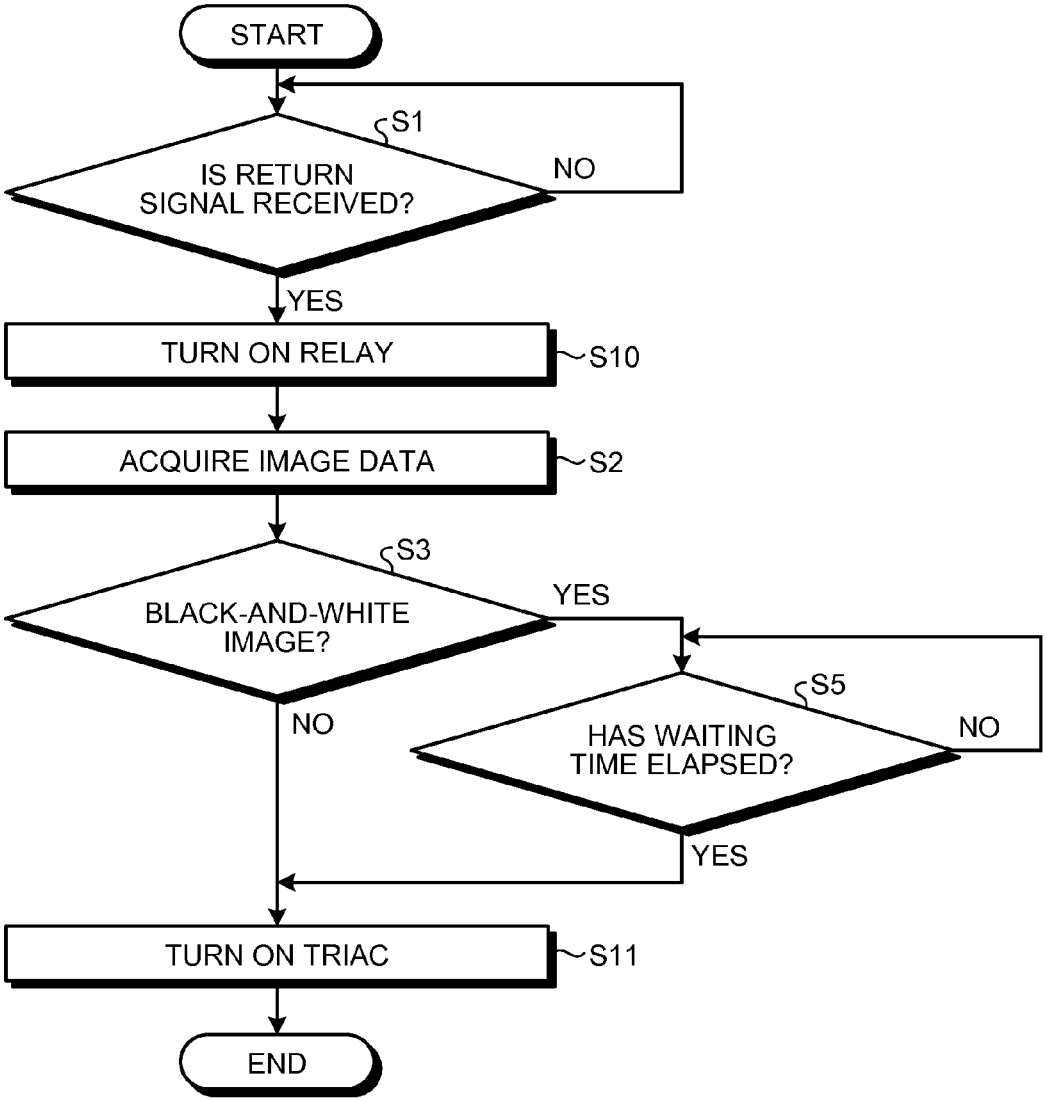
FIG. 14 is a flowchart illustrating another specific example to perform on/off control of a heater in the fixing device according to an embodiment.

FIG. 14 is a flowchart that illustrates another specific example (hereafter, this example is referred to as the "specific example 2") to perform on/off control of a switch unit that is provided between the halogen heater 123 and the power source unit.

In the specific example 2, the TRIAC is used as a switch unit to perform on/off control. An explanation is given by using, for example, the above-described warming-up operation example 1. When a return signal is received (Yes at Step S1), the relay is first turned on (Step S10) and the image data is acquired (Step S2). If it is determined that the image data is the data on a color image (No at Step S3), the TRIAC is turned on (Step S11) so that the heating of the fixing belt 121 is started. Conversely, if it is determined that the image data is the data on a black-and-white image (Yes at Step S3), the TRIAC is turned on (Step S11) after a predetermined waiting time has elapsed (Step S5) so that the heating of the fixing belt 121 is started.

The above-described explanation is only an example, and the present invention produces a specific advantage for each of the following aspects.

Aspect A

It is characterized in that an image forming apparatus includes: an image forming unit, such as the transfer belt unit 10, that forms an image on a recording medium, such as the sheet 2, in accordance with input image information; a fixing unit, such as the fixing device 100, that applies heat of a heated heating member, such as the fixing belt 121, to the image formed on the recording medium by the image forming unit so as to fix the image to the recording medium, thereby performing a heat fixing operation; an information acquiring unit, such as the controller unit 200*a* or the temperature sensor 127, that acquires warming-up time estimate information for estimating a warming-up time to increase the temperature of the heating member to a target fixing temperature; and a heating control unit, such as the engine control unit 200*b*, that controls a heating start timing of the heating member in accordance with the warming-up time estimate information acquired by the information acquiring unit.

Thus, the time period from when the warming-up operation is completed until other operating units, such as the controller unit 200*a*, are started up becomes shorter, whereby a waste of power consumption during the time period can be reduced.

Aspect B

According to the above-described aspect A, it is characterized in that the warming-up time estimate information includes image information on an image on which the heat fixing operation is performed by using the heating member after the temperature of the heating member is increased.

Thus, it is possible to determine the difference of the warming-up times due to different images that are subjected to the heat fixing operation, whereby a waste of power consumption during the time period from when the warming-up operation is completed until other operating units are started up can be prevented in a more proper manner.

Aspect C

According to the above-described aspect B, it is characterized in that the image forming unit forms, on a recording medium in accordance with input image information, a single-color image that includes any one of color images formed by using multiple types of toner of different colors or forms an image on which single-color images of two or more colors are superimposed. The heating control unit determines whether the image information is few-color image information or many-color image information, the few-color image information being for forming a single-color image, such as a black-and-white image, or a multi-color image, such as a color image, in which the number of single-color images superimposed is equal to or fewer than a predetermined number, and the many-color image information being for forming a multi-color image, such as a full-color image, in which the number of single-color images superimposed is lager than the predetermined number. The heating control unit controls the heating start timing such that when it is determined that the image information is the few-color image information, the heating start timing is later than the heating start timing when it is determined that the image information is the many-color image information.

Thus, it is possible to properly prevent a waste of power consumption that occurs when the image that is the target of the heat fixing operation is formed by using a small number of toner colors.

Aspect D

According to the above-described aspect B or C, it is characterized in that the heating control unit determines whether the image information is text image information that includes a text image only and controls the heating start timing such that, when it is determined that the image information is the text image information, the heating start timing is later than the heating start timing when it is determined that the image information is not the text image information.

Thus, it is possible to properly prevent a waste of power consumption that occurs when the image that is the target of the heat fixing operation is a text image.

Aspect E

According to any one of the above-described aspects A to D, it is characterized in that the warming-up time estimate information includes heat-accumulation state information that indicates a heat-accumulation state of the fixing unit.

Thus, it is possible to prevent a waste of power consumption that occurs when the fixing unit is in a heat-accumulation state where the amount of heat accumulated therein is large.

Aspect F

According to the above-described aspect E, it is characterized in that the heat-accumulation state information includes temperature information on the heating member.

Thus, it is possible to determine the heat-accumulation state of the fixing unit by using the existing configuration of the image forming apparatus that includes a temperature detection unit that detects the temperature information on the heating member.

Aspect G

According to the above-described aspect E or F, it is characterized in that the fixing unit performs the heat fixing operation in a state where the recording medium is pressed against the heating member by a pressing member, such as the pressing roller 122, and the heat-accumulation state information includes the temperature information on the pressing member.

Thus, it is possible to determine the heat-accumulation state of the fixing unit by using the existing configuration of the image forming apparatus that includes a temperature detection unit that detects the temperature information on the pressing member.

Aspect H

According to any one of the above-described aspects E to G, it is characterized in that the heating control unit determines whether or not the heat-accumulation state information acquired by the information acquiring unit indicates a heat-accumulation state in which an amount of accumulated heat is smaller than an amount of accumulated heat in a predetermined heat-accumulation state and controls the heating start timing such that, when it is determined that the heat-accumulation state information indicates the heat-accumulation state in which the amount of accumulated heat is smaller than the amount of accumulated heat in the predetermined heat-accumulation state, the heating start timing is later than the heating start timing when it is determined that the heat-accumulation state information indicates the heat-accumulation state in which the amount of accumulated heat is equal to or larger than the amount of accumulated heat in the predetermined heat-accumulation state.

Thus, it is possible to properly prevent a waste of power consumption that occurs when the fixing unit is in a heat-accumulation state where the amount of heat accumulated therein is large.

Aspect I

According to any one of the above-described aspects A to H, it is characterized in that the heating start timing controlled by the heating control unit is a heating start timing when a return is made from a standby state for an image forming operation, such as a standby mode or sleep mode, after the image information is input.

Thus, it is possible to prevent a waste of power consumption upon return from the standby mode or the sleep mode.

Aspect J

According to any one of the above-described aspects A to I, it is characterized in that the fixing unit includes a switch unit that switches on/off electric current applied to the heating member, and the heating control unit controls a timing in which the switch unit switches on/off the electric current applied to the heating member so as to control the heating start timing.

Thus, the heating start timing can be controlled by using a simple configuration.

Aspect K

According to the above-described aspect J, it is characterized in that the switch unit is a relay.

Thus, a simple switch unit can be easily obtained.

Aspect L

According to the above-described aspect J, it is characterized in that the switch unit is a bidirectional thyristor.

Thus, a simple switch unit can be easily obtained.

According to an aspect of the present invention, it is possible to produce an advantage, i.e., to reduce a waste of power consumption that is required to keep the fixing temperature until the other operating units are started up.

According to the present invention, it is possible to perform control such that, if the estimated warming-up time is short which is estimated from warming-up time estimate information, the heating start timing of the heating member is delayed. Thus, compared to a conventional configuration in which the same heating start timing is equally set even though the warming-up times are different, it is possible to reduce the difference between the time when warming-up is completed and the time when a heat fixing operation is performed in a case where the warming-up time is short. Thus, it is possible to shorten the time period from when warming-up is completed to when the other operating units are started up so that a fixing operation is actually performed. As a result, it is possible to reduce a waste of electric power that is consumed during the time period, i.e., wasted power consumption that is required to keep the fixing temperature until the other operating units are started up.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit configured to form an image on a recording medium in accordance with input image information;

a fixing unit configured to apply heat of a heated heating member to the image formed on the recording medium by the image forming unit so as to fix the image to the recording medium, thereby performing a heat fixing operation;

an information acquiring unit configured to acquire warming-up time estimate information for estimating a warming-up time to increase a temperature of the heating member to a target fixing temperature, the warming-up time estimate information including information related to at least a type of the image and heat-accumulation state information of the fixing unit; and a heating control unit configured to control a heating start timing of the heating member based on the type of the image and a waiting time determined based on the heat-accumulation state information.

2. The image forming apparatus according to claim 1, wherein the heat fixing operation is performed on the image by using the heating member after the temperature of the heating member is increased.

3. The image forming apparatus according to claim 2, wherein the image forming unit is configured to form, on the recording medium in accordance with input image information, any one of a single-color image that includes any one of color images formed by using multiple types of toner of different colors, a few-color image on which single-color images of two or more colors are superimposed where a number of the single-color images are less than a threshold and a multi-color image where the number of single-color images are greater than the threshold, and the heating control unit is configured to, determine, based on the type of the image, whether the image is the single-color image, the few-color image or the multi-color image, and control the heating start timing such that, when it is determined that the image is at least one of the single-color image and the few-color image, the heating start timing is later than the heating start timing when it is determined that the image information is the multi-color image.

4. The image forming apparatus according to claim 2, wherein the heating control unit is configured to determine, based on the type of the image, whether or not the image is a text image only, and control the heating start timing such that, when it is determined that the image is the text image only, the heating start timing is later than the heating start timing when it is determined that the image is not the text image only.

5. The image forming apparatus according to claim 1, wherein the heat-accumulation state information includes temperature information on the heating member.

6. The image forming apparatus according to claim 1, wherein the fixing unit performs the heat fixing operation in a state where the recording medium is pressed against the heating member by a pressing member, and the heat-accumulation state information includes temperature information on the pressing member.

7. The image forming apparatus according to claim 1, wherein the heating control unit is configured to determine whether or not the heat-accumulation state information indicates a heat-accumulation state in which an amount of accumulated heat is smaller than an amount of accumulated heat in a particular heat-accumulation state, and control the heating start timing such that, when it is determined that the heat-accumulation state information indicates the heat-accumulation state in which the amount of accumulated heat is smaller than the amount of accumulated heat in the particular heat-accumulation state, the heating start timing is later than the heating start timing when it is determined that the heat-accumulation state information indicates the heat-accumulation state in which the amount of accumulated heat is equal to or larger than the amount of accumulated heat in the particular heat-accumulation state.

8. The image forming apparatus according to claim 1, wherein the heating start timing is a heating start timing when a return is made from a standby state for an image forming operation after the image information is input.

9. The image forming apparatus according to claim 1, wherein the fixing unit includes a switch unit configured to switch on or switch off an electric current applied to the heating member, and the heating control unit is configured to control a timing in which the switch unit switches on or switches off the electric current applied to the heating member so as to control the heating start timing.

10. The image forming apparatus according to claim 9, wherein the switch unit is a relay.

11. The image forming apparatus according to claim 9, wherein the switch unit is a bidirectional thyristor.

12. The image forming apparatus according to claim 1, wherein the heating control unit is configured to, determine whether the type of the image indicates that the image is a single-color image, acquire the heat accumulation state information if the type of the image indicates that the image is the single-color image, and control the heating start timing based on the determined waiting time.

13. An image forming apparatus comprising:

a control unit configured to, acquire warming-up time estimate information for estimating a warming-up time to increase a temperature of a heating member to a target fixing temperature, the warming-up time estimate information including information related to at least a type of the image and heat-accumulation state information of a fixing unit, the heating member being configured to heat up the fixing device for fixing an image onto a recording medium; and control a heating start timing of the heating member based on the type of the image and a waiting time determined based on the heat-accumulation state information.

14. The image forming apparatus according to claim 13, wherein the type of the image indicates whether the image is a single color image or a multi-color image.

15. The image forming apparatus according to claim 14, wherein if the type of the image indicates that the image is the single color image, the control unit is configured to control the heating start timing such that a heating of the heating member is delayed compared to an initial time set for starting the heating of the heating member.

16. The image forming apparatus according to claim 14, wherein if the type of the image indicates that the image is the multi-color image, the control unit is configured to control the heating start timing such that a heating of the heating member starts at an initial time set for starting the heating of the heating member.

17. The image forming apparatus according to claim 13, wherein the type of the image indicates whether the image is a text image or not.

18. The image forming apparatus according to claim 17, wherein if the type of the image indicates that the image is a text image, the control unit is configured to control the heating start timing such that a heating of the heating member is delayed compared to an initial time set for starting the heating of the heating member.

* * * * *